US012454945B2

(12) United States Patent
Chase et al.

(10) Patent No.: US 12,454,945 B2
(45) Date of Patent: Oct. 28, 2025

(54) PARTIAL STROKE FLUIDIC PUMP-MOTOR WITH HIGH MECHANICAL EFFICIENCY

(71) Applicant: REGENTS OF THE UNIVERSITY OF MINNESOTA, Minneapolis, MN (US)

(72) Inventors: Thomas Richard Chase, Minneapolis, MN (US); Perry Yan-Ho Li, Plymouth, MN (US); Michael B. Rannow, Eden Prairie, MN (US)

(73) Assignee: REGENTS OF THE UNIVERSITY OF MINNESOTA, Minneapolis, MN (US)

( * ) Notice: Subject to any disclaimer, the term of this patent is extended or adjusted under 35 U.S.C. 154(b) by 0 days.

(21) Appl. No.: 18/142,104

(22) Filed: May 2, 2023

(65) Prior Publication Data

US 2023/0358217 A1 Nov. 9, 2023

Related U.S. Application Data

(60) Provisional application No. 63/337,720, filed on May 3, 2022.

(51) Int. Cl.
*F04B 1/0531* (2020.01)
*F04B 1/0413* (2020.01)
*F04B 1/0452* (2020.01)

(52) U.S. Cl.
CPC ..... *F04B 1/0531* (2013.01); *F04B 1/0413* (2013.01); *F04B 1/0452* (2013.01)

(58) Field of Classification Search
USPC ..... 417/437; 290/55; 60/327
See application file for complete search history.

(56) References Cited

U.S. PATENT DOCUMENTS 2,379,180 A * 6/1945 Pohl ..... F15B 11/024 91/417 R
2,978,986 A * 4/1961 Carder ..... F02B 71/045 60/595

(Continued)

FOREIGN PATENT DOCUMENTS

EP 1306553 A2 * 5/2003 ..... F02D 41/3845
EP 1537333 B1 6/2006

OTHER PUBLICATIONS

Machine Translation of EP1306553 Rembold (Obtained from https://worldwide.espacenet.com/patent/search/family/007703999/publication/EP1306553A2?q=de10153189) (Year: 2025).*

(Continued)

*Primary Examiner* — Dominick L Plakkoottam
*Assistant Examiner* — Geoffrey S Lee
(74) *Attorney, Agent, or Firm* — Mueting Raasch Group

(57) ABSTRACT

A partial stroke pump or motor includes a piston coupled to a rotating shaft to evacuate a fluid within a cylinder during an upstroke. A latching check valve includes an actuator piston that is displaceable within a center cavity to bypass a blocking member in a bypass state. The actuator piston is driven by a latch supply line. A spool of a rotary valve selectively couples one of the low and pilot pressure supplies to the latch supply line over different timing angle ranges of the rotating shaft. Coupling of the pilot pressure to the latch supply line causes the bypass state. When operating as a pump, the bypass state causes the pressure in the cylinder to fall below the high pressure during part of the upstroke. When operating as a motor, the bypass state allows the fluid to be evacuated from the cylinder during the upstroke.

21 Claims, 30 Drawing Sheets

(56) References Cited

U.S. PATENT DOCUMENTS

| | | | | |
|---|---|---|---|---|
| 4,432,698 | A * | 2/1984 | Shirakuma | F04B 49/06 417/27 |
| 4,459,085 | A * | 7/1984 | Tonegawa | B60T 15/50 417/282 |
| 4,522,568 | A * | 6/1985 | Gelse | F04B 49/243 417/307 |
| 5,190,446 | A * | 3/1993 | Salter | F04B 49/065 417/297 |
| 5,340,285 | A * | 8/1994 | Reinartz | F04B 1/066 417/221 |
| 5,547,348 | A * | 8/1996 | Riley | F04B 1/0538 74/570.21 |
| 5,551,478 | A * | 9/1996 | Veilleux, Jr. | F15B 21/08 137/596.15 |
| 5,634,777 | A * | 6/1997 | Albertin | F04B 1/0421 74/570.21 |
| 6,315,265 | B1 * | 11/2001 | Adler | F16K 31/122 251/32 |
| 6,655,362 | B2 * | 12/2003 | Rembold | F02M 59/102 123/506 |
| 6,681,571 | B2 | 1/2004 | Bailey et al. | |
| 9,091,253 | B2 * | 7/2015 | Stein | F04B 49/24 |
| 10,012,228 | B2 * | 7/2018 | Esders | F04B 49/03 |
| 10,738,757 | B2 * | 8/2020 | Rannow | F04B 1/146 |
| 2006/0039795 | A1 * | 2/2006 | Stein | F01B 25/10 417/1 |
| 2007/0258832 | A1 | 11/2007 | Caldwell et al. | |
| 2010/0084587 | A1 | 4/2010 | Stein | |
| 2010/0143171 | A1 * | 6/2010 | Gaumnitz | F04B 53/1082 417/505 |
| 2010/0303657 | A1 * | 12/2010 | Kuttler | F04B 49/243 417/505 |
| 2011/0020159 | A1 * | 1/2011 | Kuttler | F04B 53/1082 417/505 |
| 2011/0268590 | A1 * | 11/2011 | Stein | F04B 7/0076 417/302 |
| 2012/0059523 | A1 | 3/2012 | Salter et al. | |
| 2012/0186659 | A1 | 7/2012 | Lumkes et al. | |
| 2014/0147323 | A1 * | 5/2014 | Watanabe | F04C 14/226 418/30 |
| 2015/0300349 | A1 * | 10/2015 | Esders | F04B 1/0452 417/506 |
| 2017/0159641 | A1 * | 6/2017 | Rannow | F03C 1/0613 |
| 2023/0358217 | A1 * | 11/2023 | Chase | F04B 1/0452 |

OTHER PUBLICATIONS

"Digital Displacement® pumps," Web page from Danfoss, Retrieved Oct. 18, 2024 from the Internet: <URL: danfoss.com/en/products/dps/hydraulic-pumps/mobile-pumps/mobile-piston-pumps/digital-displacement-pumps/ > 5 pages. Believed to be available as early as 2015.

Dynex Pump & Valve Guide "High Pressure Pumps & Valves: Hydraulic Components for Extreme Applications" [online]. Dynex High Pressure Hydraulics/Rivett, Inc., Pewaukee, WI., Jan. 2024; [retrieved Oct. 18, 2024]. Retrieved from the Internet: <URL: dynexhydraulics.com/support/literature/>, 16 pages. Believed to be available as early as 2015.

Product Page for "PV4000-11 Series Pressure Compensated Pumps" Dynex High Pressure Hydraulics, Pewaukee, WI. Retrieved Oct. 18, 2024 from the Internet: <URL: dynexhydraulics.com/product/pv4000-11-series-pressure-compensated-pumps/> 4 pages. Believed to be available as early as 2015.

Product Page for "PV6000 Variable Delivery Pumps—Hydraulic Input" Dynex High Pressure Hydraulics/Rivett, Inc., Pewaukee, WI. Retrieved Oct. 18, 2024 from the Internet: <URL: dynexhydraulics.com/product/pv6000-series-variable-delivery-pumps/> 4 pages. Believed to be available as early as 2015.

Ehsan et al., "Modeling of Digital-Displacement Pump—Motors and Their Application as Hydraulic Drives for Nonuniform Loads," ASME Journal of Dynamic Systems Measurement and Control, 2000, vol. 122, pp. 210-215.

"Hydrowatt Pump Technology" Web page from Hydrowatt website, Believed to be available at least as early as 2022 [online]. Retrieved from the Internet: <URL: (former hyperlink is incomplete and broken>; 2 pages, [retrieved on Mar. 24, 2022]. Updated hyperlink for the information can be found on the Internet: <URL: hydrowatt.com/high-pressure-pumps/our-technology.html>; 2 pages, [retrieved on Oct. 11, 2024].

Linjama, M., "Digital Fluid Power—State of the Art" 2011, Twelfth Scandinavian International Conference on Fluid Power from May 18-20, 2011; Tampere, Finland. 23 pages.

Rampen, W., Salter, S., and Fussey, A., "Constant Pressure Control of the Digital Displacement Pump," 4th Bath International Fluid Power Workshop—Fluid Power Systems and Modeling, Bath, 1991, pp. 45-62.

Rampen, W., Almond, J., and Salter, S., "The Digital Displacement Pump/Motor Operating Cycle: Experimental Results Demonstrating the Fundamental Characteristics," International Fluid Power Workshop, Bath, 1994, pp. 321-331.

Rannow et al., "Discrete Piston Pump/Motor Using a Mechanical Rotary Valve Control Mechanism" 2016, Proceedings of the Eighth Workshop on Digital Fluid Power from May 24-25, 2016; Tampere, Finland. 12 pages.

Tammisto et al., "Measured Characteristics of an In-line Pump with Independently Controlled Pistons" 2010, 7th International Fluid Power Conference in Aachen, Germany. 12 pages.

Wadsley, "Optimal System Solutions Enabled by Digital Pumps" Proceedings of the 52nd National Conference on Fluid Power in Las Vegas, NV. 2011; 6 pages.

* cited by examiner

PARTIAL STROKE FLUIDIC PUMP-MOTOR WITH HIGH MECHANICAL EFFICIENCY

RELATED PATENT DOCUMENTS

This application claims the benefit of U.S. Provisional Application No. 63/337,720, filed on May 3, 2023, which is incorporated herein by reference in its entirety.

STATEMENT REGARDING FEDERALLY SPONSORED RESEARCH OR DEVELOPMENT

This invention was made with government support under IIP-1700747 awarded by the National Science Foundation. The government has certain rights in the invention.

SUMMARY

This document describes a piston pump-motor architecture with very high mechanical efficiency. The pump-motor can be used with either liquids or gases. The pump-motor can be used exclusively as a pump, exclusively as a motor, or as a combination pump and motor (pump-motor).

In one embodiment, an apparatus is configurable as one or both of a partial stroke pump or a partial stroke motor. The apparatus includes a piston coupled to a rotating shaft to evacuate a fluid within a cylinder during an upstroke. A latching check valve is in fluid communication with: a low pressure port of the cylinder; a low pressure supply line at a low pressure; and a latch supply line. A rotary valve selectively couples one of the low pressure supply and a pilot pressure supply of the fluid to the latch supply line over different timing angle ranges of the rotating shaft. The pilot pressure supply has a pressure greater than the low pressure. A change from low pressure to pilot pressure or vice versa to the latch supply line maintains a bypass state of the latching check valve. When operating as the partial stroke pump, the bypass state allows the pressure in the cylinder to fall below the high pressure during part of the upstroke. When operating as the partial stroke motor, the bypass state allows the fluid to be evacuated from the cylinder during the upstroke.

In another embodiment, an apparatus includes an eccentric rotatable about an axis. The axis is offset from a geometric center of the eccentric and the eccentric has a circular outer surface. A drive shaft is rotatable about the axis and is fixably coupled to the eccentric at the axis. A cam rotates about the circular outer surface of the eccentric. An outer perimeter of the cam has a flat face.

The apparatus includes a cylinder that is fixed in relation to the axis and is located outboard of the flat face. A piston linearly translates within the cylinder. Two cam followers are attached to an end of the piston located between the flat face of the cam and the cylinder. The cam followers include rolling elements in contact with the flat face of the cam. A biasing element presses the cam followers against the flat surface. Rotation of the drive shaft results in or from the linear translation of the piston within the cylinder and a movement of the cam followers relative to the flat face in a direction normal to the linear translation.

In another embodiment, an apparatus is configurable as one or both of a partial stroke pump or a partial stroke motor. The apparatus includes a piston coupled to a rotating shaft to evacuate a fluid within a cylinder during an upstroke. The cylinder includes high pressure and low pressure ports. A high pressure check valve opens or closes the high pressure port if a pressure of the fluid in the cylinder goes respectively above or below a high pressure. A latching check valve is in fluid communication with the low pressure port. The latching check valve includes a center cavity in fluid communication with the low pressure port. The latching check valve also includes a seat between a low pressure supply of the fluid and the center cavity and a blocking member biased to move towards the seat and to block flow therethrough when the pressure in the cylinder is above the low pressure. The blocking member moves away from the seat if the pressure in the cylinder drops below the low pressure so that low pressure fluid bypasses the blocking member and flows into the cylinder in the bypass state. The latching check valve also includes an actuator piston that is linearly displaceable within the center cavity to allow fluid to bypass the blocking member in a bypass state of the latching check valve, the actuator piston driven by a latch supply line.

The apparatus includes a rotary valve in fluid communication with the latch supply line and comprising a spool rotatably coupled to the rotating shaft. The spool selectively couples one of the low pressure supply and a pilot pressure supply of the fluid to the latch supply line over different timing angle ranges of the rotating shaft. The pilot pressure supply has a pressure greater than the low pressure. A change of pressure to the latch supply line causes the bypass state of the blocking member to be maintained. When operating as a partial stroke pump, the bypass state causes the pressure in the cylinder to fall below the high pressure during part of the upstroke. The high pressure check valve is closed in the bypass state. When operating as a partial stroke motor, the bypass state allows the fluid to be evacuated from the cylinder during the upstroke.

BRIEF DESCRIPTION OF THE DRAWINGS

The discussion below makes reference to the following figures, wherein the same reference number may be used to identify the similar/same component in multiple figures.

DETAILED DESCRIPTION

The features of the architecture are illustrated in this document by utilizing the novel mechanical system comprising a "check ball pump" for hydraulic fluid. However, the same mechanical system can also be used to pump other liquids or gases. Moreover, the same mechanical system can be used with different valving strategies to implement alternative pump embodiments, motor embodiments, or pump-motor embodiments. The architecture described here will maintain its high mechanical efficiency attributes regardless of its specific application.

Figure 1:
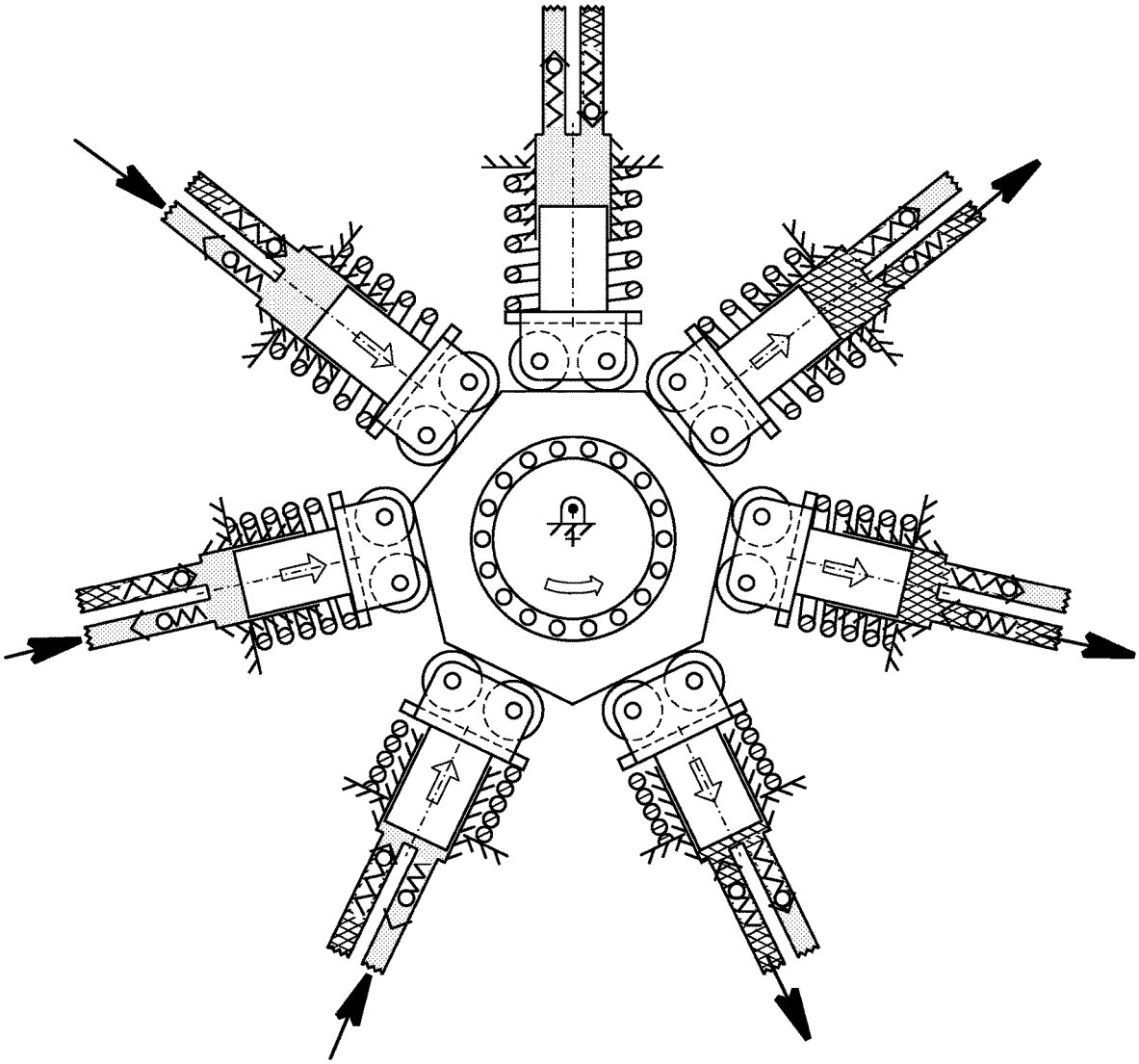
FIG. 1 is a diagram of a seven-piston radial check ball piston pump according to an example embodiment.

The block diagram in FIG. 1 illustrates the architecture in the context of a seven-piston radial check ball piston pump. The design is adaptable to any number of pistons, particularly for a pump implementation. The nomenclature used to describe the architecture is introduced in FIG. 2. Only one piston 100 is shown for clarity. The driving shaft (not shown) of the pump rotates an eccentric 101 relative to the frame (not shown) of the pump. Generally, any part of the drawings showing a mechanical ground (a series of short diagonal lines extending from a surface line) may be considered fixedly coupled to the frame. The eccentric 101 is a simple cylinder which is rotated about a center 102 (also referred to herein as an axis) which is offset from the geometric center 104 of the eccentric 101. The bearings (not shown) which support the driving shaft relative to the frame are centered about the center of rotation 102 of the eccentric 101, not the geometric center 104 of the eccentric. Thus, the center of rotation 102 of the eccentric 101 (the axis) is fixed relative to the frame.

A cam 105 surrounds the eccentric. The outer surface of the cam 105 includes a connected series of flat faces or surfaces 106. The number of flat faces 106 equals the number of pistons 100. The angle φ between adjoining flat faces 106 is the same for every connected pair of flat faces 106. The numerical value of the angle φ is (180°-360°/N), where N is the number of pistons 100. The perpendicular distance from the geometric center 104 of the eccentric 101 to any face 106 of the cam 105 is the same for all faces.

The eccentric 101 rotates a full 360° relative to the frame as the drive shaft is rotated. However, the cam 105 does not rotate relative to the frame. Therefore, a bearing 103 is used between the rotating eccentric 101 and the non-rotating cam 105. This bearing 103 is illustrated as a roller bearing in FIG. 2. However, other bearing types could be used, such as ball bearings, needle roller bearings, or tapered roller bearings. Journal bearings could also be used, although rolling element bearings are preferred, as journal bearings will lose more energy to friction than rolling element bearings.

Figure 2:
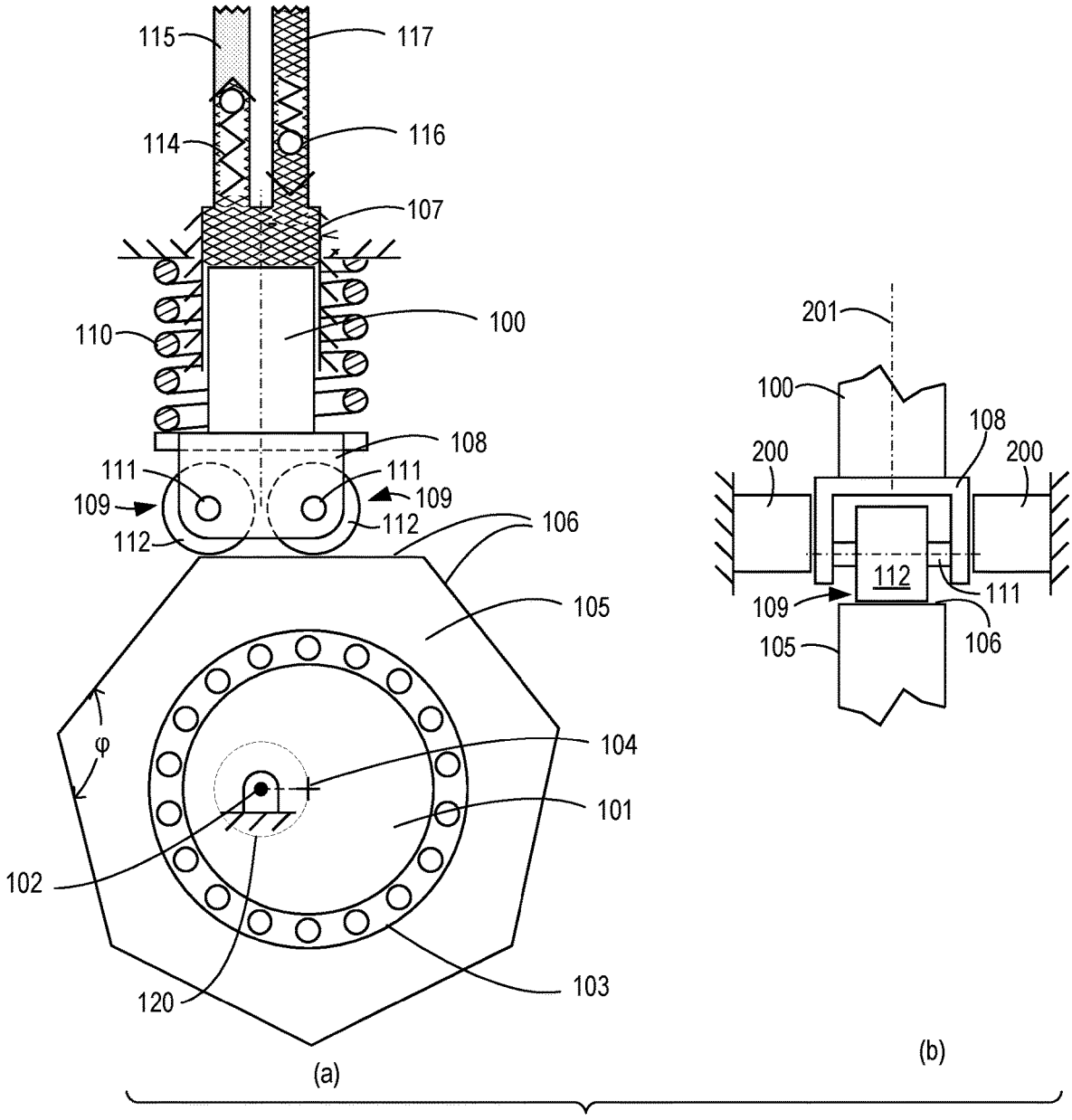
FIG. 2 are front and end views of a piston drive train used in a pump or motor according to example embodiments.

The piston 100 slides in the piston cylinder 107. The piston cylinder 107 is fixed relative to the frame and axis 102. Also note the piston cylinder 107 is shown centered over the axis 102 and is located normal to the top flat surface 106. Kinematically, the piston 100 traveling along the piston cylinder 107 forms a slider, or prismatic, joint. The slider joint prevents rotational motion of the piston 100 relative to ground in the plane of motion of the eccentric 101 and the cam 105. Therefore, the piston 100 travels with a pure translating motion. The piston 100 is rigidly attached to a piston carriage assembly 108, which also includes two cylindrical cam followers 109, also referred to herein as rolling elements. In some embodiments, a means is provided to prevent out-of-plane rotation of the piston carriage assembly about the center axis of the cylinder, such as one or more guide surfaces included on the frame. For example, the end view (b) of FIG. 2 schematically shows guides 200 that constrain the piston carriage assembly 108 from rotating about the center axis 201 of the cylinder.

A biasing element 110, such as a return spring, presses the two cam followers 109 of each piston carriage assembly 108 against one of the flat faces 106 of the cam 105. Rotating the drive shaft at a constant angular velocity causes the piston 100 to travel up and down in the piston cylinder 107 with a sinusoidal motion.

The cam followers 109 may include standard, commercially available cam follower bearings. Such bearings are desirable because they have integral rolling element bearings which allow their outer races to rotate with little frictional energy loss. In addition, the outer races are thicker than those used on ordinary rolling element bearings, so they deflect very little while making contact with the face 106 of the cam 105. Nevertheless, it is also possible to construct cam followers 109 with simple journal bearings at their centers, at the cost of a slightly larger transverse frictional load arising at the point of contact of the cam follower 109 with the face 106 of the cam 105.

A cam follower 109 comprises a shaft 111, which in the case of the radial pump-motor described here is affixed to the piston carriage 108 assembly, a large diameter cylindrical roller 112, which in the case of the radial pump-motor described here rolls on a flat face 106 of the cam 105, and a bearing (not shown) between the large diameter cylindrical roller 112 and the shaft 111. In this embodiment, the shaft 111 remains fixed relative to the carriage assembly 108, and the bearing allows the large diameter cylindrical roller to rotate freely relative to the shaft 111. An alternative for constructing the cam follower 109 comprises rigidly coupling the shaft 111 to the large diameter cylindrical roller 112, then including bearings (not shown) between the shaft 111 and the piston carriage assembly 108. In the alternative embodiment, the shaft 111 rotates with the roller 112, and the bearings allow the integral shaft 111 and large diameter cylindrical roller 112 to rotate freely relative to the piston carriage assembly 108. Any bearing type may be used, including needle roller bearings, ball bearings or journal bearings. The alternative embodiment sometimes enables constructing cam followers 109 which can carry larger loads in a more compact space.

Also seen in FIG. 2 are a low pressure valve 114, a low pressure supply 115, and high pressure valve 116, and a high pressure supply 117. The low and high pressure supplies 115, 117 provide a respective source and sink of a working fluid of the cylinder 107 in pumping mode, and a respective sink and source of working fluid in a motoring mode. In a pump implementation, the low and high pressure valves 114, 116 are check valves. In a motor implementation, the low and high pressure valves 114, 116 are active valves, e.g., that are opened and closed via a mechanical and/or electrical controller.

Figure 3:
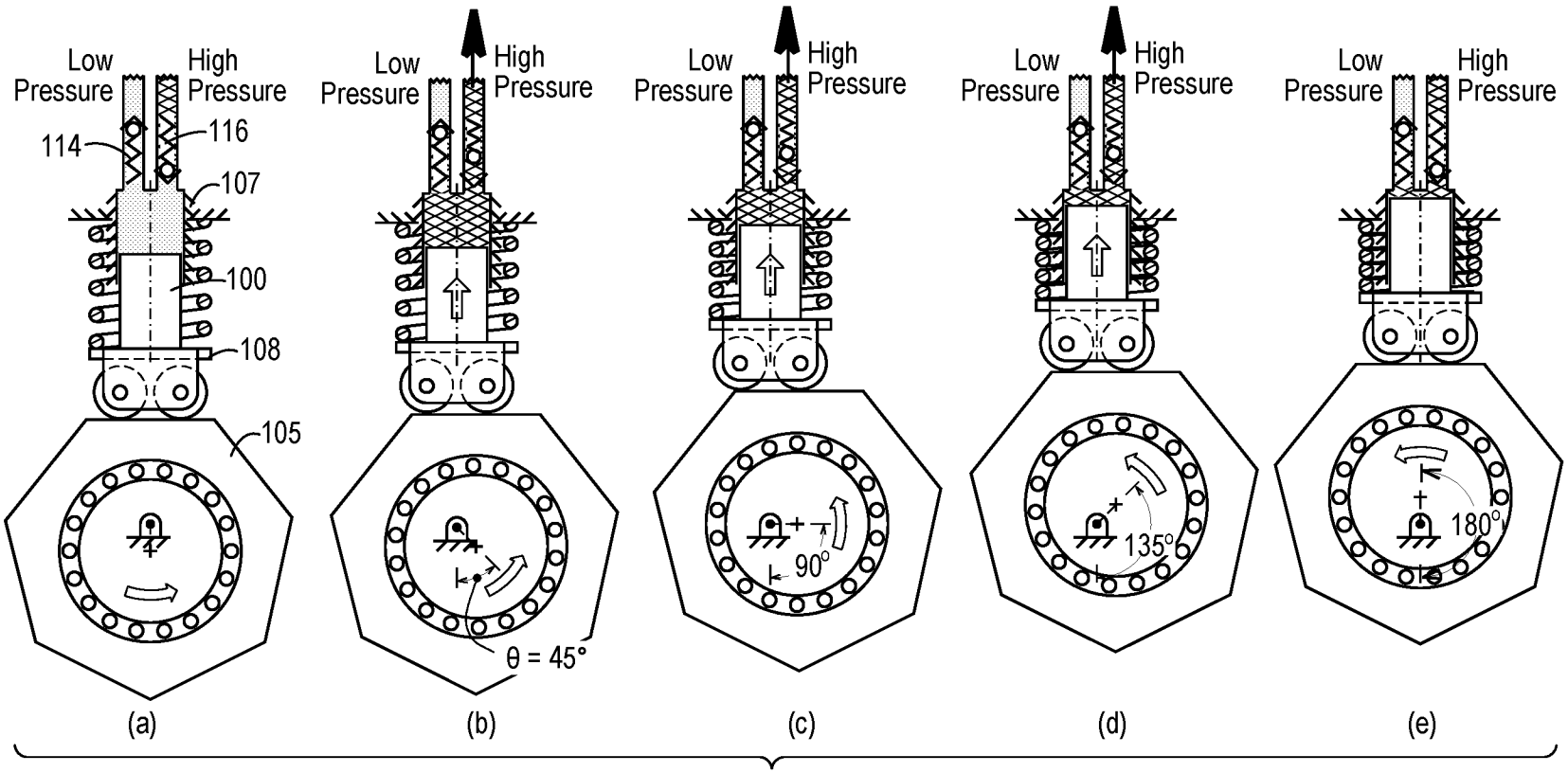
FIGS. 3 and 4 are diagrams showing positions of a pump during the pumping and return strokes according to an example embodiment.

The motion of the mechanism during the pumping stroke is illustrated with a series of five contiguous positions of the mechanism in FIG. 3. The reference character 6 represents the angle of the driving crank. The piston is shown at bottom dead center at view (a) in FIG. 3. The crank angle is defined to be 0 at bottom dead center (BDC). Note that while the high and low pressure valves 114, 116 shown in these figures are illustrated as ball check valves, any type of valve may be used, such as disc or poppet check valves. Further, active valves, which may include any type of valve that is mechanically and/or electrically activated at selected crank angles, may be used when a motor or combination pump and motor operation is desired.

As the crank angle increases to 45° (see view (b) in FIG. 3)), the cam 105 rises up, forcing the piston 100 into the piston cylinder 107. The piston motion causes the pressure of the fluid in the cylinder 107 to rise. The fluid pressure in the cylinder 107 forces the low pressure check valve 114 closed. The high pressure check valve 116 is also closed at BDC. However, when the fluid pressure slightly exceeds the high pressure of the system during the upstroke of the piston 100, the high pressure check valve 116 opens, and high pressure fluid is pumped to the load. Note that the cam 105 also moves to the right relative to the piston carriage assembly 108. The cam followers roll along the face of the cam 105 in order to accommodate this sideways motion.

The cam 105 reaches its rightward limit of motion relative to the piston carriage assembly when the crank angle reaches 90° (see view (c) in FIG. 3). The cam face is sized so that the left cam follower approaches, but does not reach, the left edge of the face of the cam 105. The cam followers momentarily stop rolling at 6=90°, as their direction of rolling changes from counterclockwise (CCW) to clockwise (CW). The rate of fluid displaced to the load reaches its maximum at 6=90°.

As the crank angle increases to 135° (view (d) in FIG. 3)), the piston 100 continues to rise, sending high pressure fluid to the load. The face of the cam 105 now moves left relative to the piston carriage assembly. The cam followers roll clockwise to allow this motion. The piston 100 reaches top dead center (TDC) at 6=180° (view (e) in FIG. 3)). The direction of motion of the piston 100 reverses at TDC. As the crank angle advances past 180°, the piston 100 stops sending high pressure fluid to load, the pressure of the fluid in the piston cylinder 107 drops, and the high pressure check valve 116 closes. The cam followers are centered on the face of the cam at TDC, and the relative sideways motion between the cam 105 and the piston carriage assembly 108 reaches its peak velocity.

Figure 4:
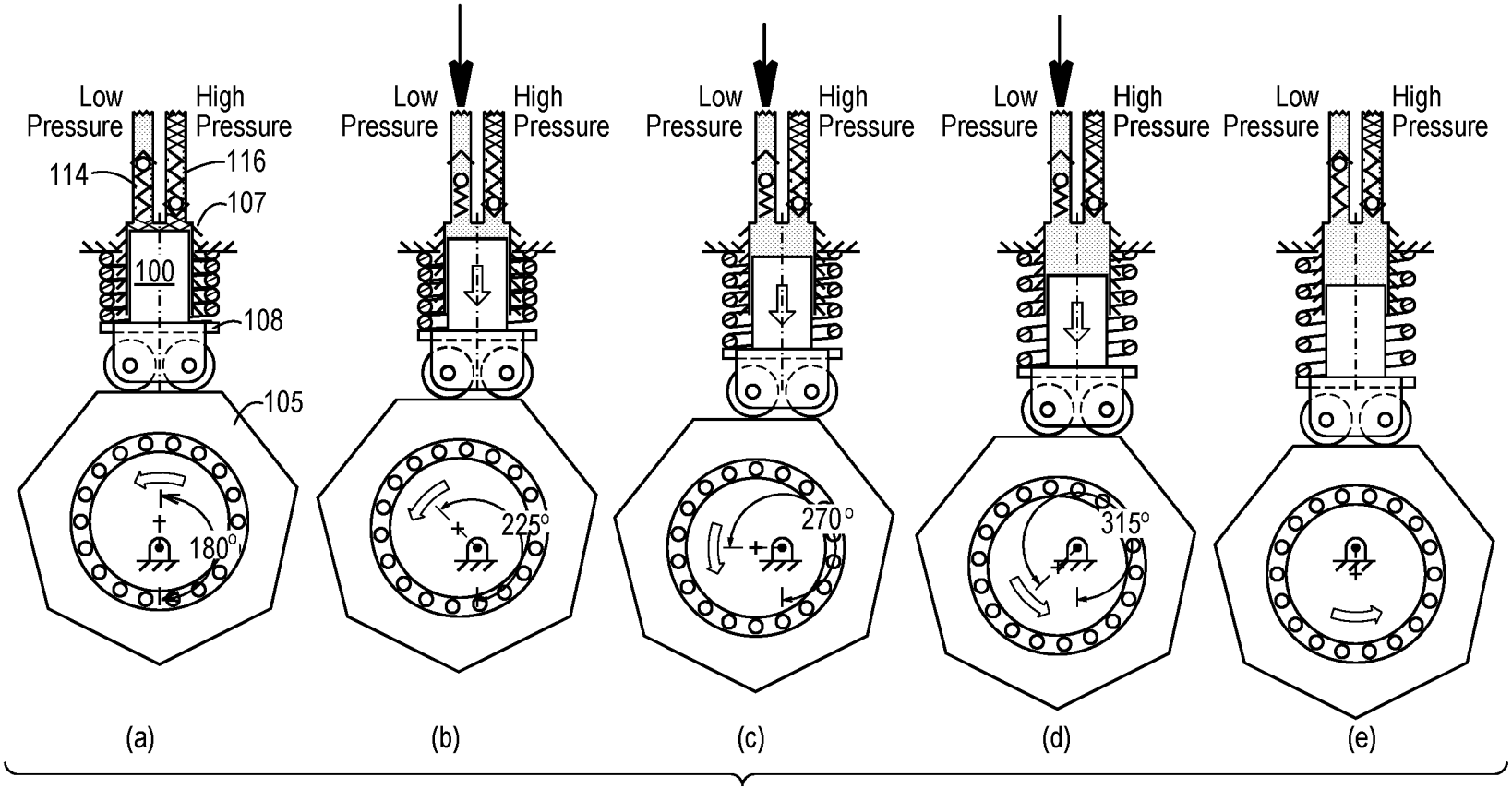

The return stroke of the piston is illustrated in FIG. 4. The top dead center position is repeated in view (a) of FIG. 4 for clarity. The horizontal face of the piston 100 is moving downward at 6=225° in view (b) of FIG. 4. The return spring or biasing element forces the piston carriage assembly 108 downward so that the cam followers continue to contact the face of the cam 105. The fluid pressure drops further as the piston 100 moves down in the piston cylinder 107. When the pressure of the fluid drops slightly below the pressure of the fluid in the low pressure supply, the low pressure check valve 114 opens, and the piston 100 draws low pressure fluid into the piston cylinder 107. The cam 105 continues to move leftward relative to the carriage assembly.

The cam 105 reaches its leftward limit of motion relative to the piston carriage assembly 108 as the crank angle reaches 270° (see view (c) in FIG. 4). The right cam follower approaches, but does not reach, the right edge of the face of the cam. The cam followers momentarily stop rolling at this position, as their direction of rolling shifts from clockwise to counterclockwise. The piston 100 reaches its maximum downward velocity at this position.

The cam 105 again moves rightward relative to the piston carriage assembly at 6=315° (see view (d) in FIG. 4). The piston 100 continues to draw low pressure fluid into the piston cylinder 107, although the rate of flow of fluid into the cylinder declines. The piston 100 returns to its bottom dead center position when 6=360° (see view (e) in FIG. 4). The direction of piston motion reverses from downward to upward at BDC. The piston 100 stops drawing fluid into the piston cylinder, and the low pressure check valve 114 closes. The relative sideways motion between the cam 105 and the piston carriage assembly 108 again reaches its peak velocity. As the driving crank continues to rotate, the pumping motion illustrated in FIG. 3 begins again.

While the above description is based on counterclockwise motion of the eccentric, equivalent functionality can be obtained by rotating the eccentric in the clockwise direction.

Note that the same structure can be used for a motor, however the high and low pressure check valves 114, 116 shown in FIG. 3 would be replaced with active valves that can be controllably activated to open and close at different crank angles. During the downward stroke, pressurized fluid in the cylinder 107 will push the piston 100 down toward the cam 105 and rotate the eccentric when the center of the eccentric is not vertically aligned with the axis of the cylinder during the downstroke half-cycle. During the other half-cycle, the high pressure valve 116 closes and the low pressure valve 114 opens, causing the fluid to be evacuated from the cylinder 107 during the upstroke. More than one piston 100 and cylinder 107 may be needed in a motor implementation to drive the upward stroke (fluid evacuation stroke), although in some cases a start assist may be used (e.g., other pistons, electric motor) to provide the power needed for the upstroke when starting the motor, which thereafter may be driven by momentum (e.g., using a flywheel) once the motor is started.

Figure 5:
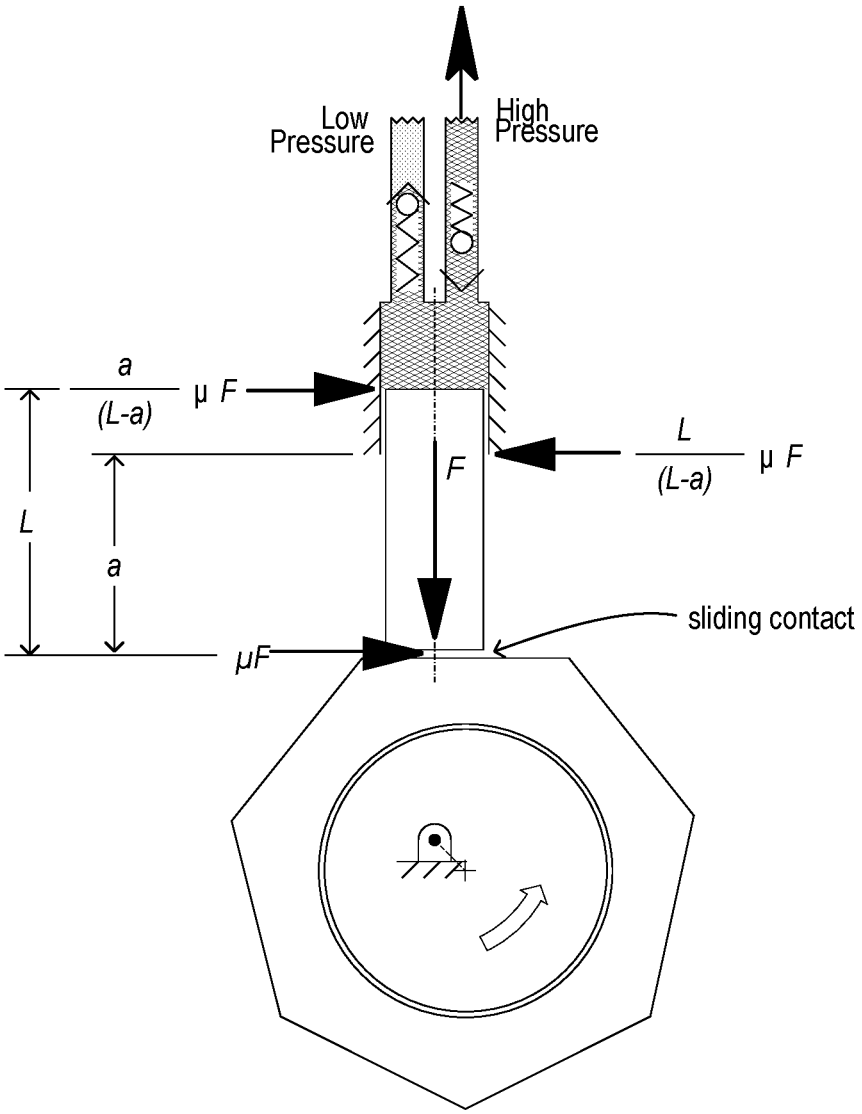
FIGS. 5, 6, and 7 are diagrams showing mechanical loads associated with designs according to example embodiments.

The use of the cam follower bearings makes the architecture described here kinematically and functionally distinct. The architecture is a six link mechanism with four revolute joints, one prismatic joint and two pure rolling joints. A functional difference between the new architecture and existing architectures is shown in FIG. 5. If a sliding contact is used between the face of the cam and the end of the piston, a transverse frictional force will be introduced. If the force on the piston is F, then the magnitude of this force is $\mu F$, where $\mu$ represents the coefficient of friction at the point of contact. While $\mu$ may be low (on the order of magnitude of 0.05 for a well-lubricated interface), F is typically very high, so the transverse force is significant.

As suggested in FIG. 5, the transverse load of $\mu F$ creates a bending load on the piston. The bending moment caused by the transverse force leads to two transverse loads arising on the piston where it engages with the cylinder: one at the top of the piston and one at the point where the piston exits the cylinder. While the actual load will be distributed over a small region of contact between the piston and the cylinder wall, these loads are approximated as point loads in FIG. 5.

Figure 6:
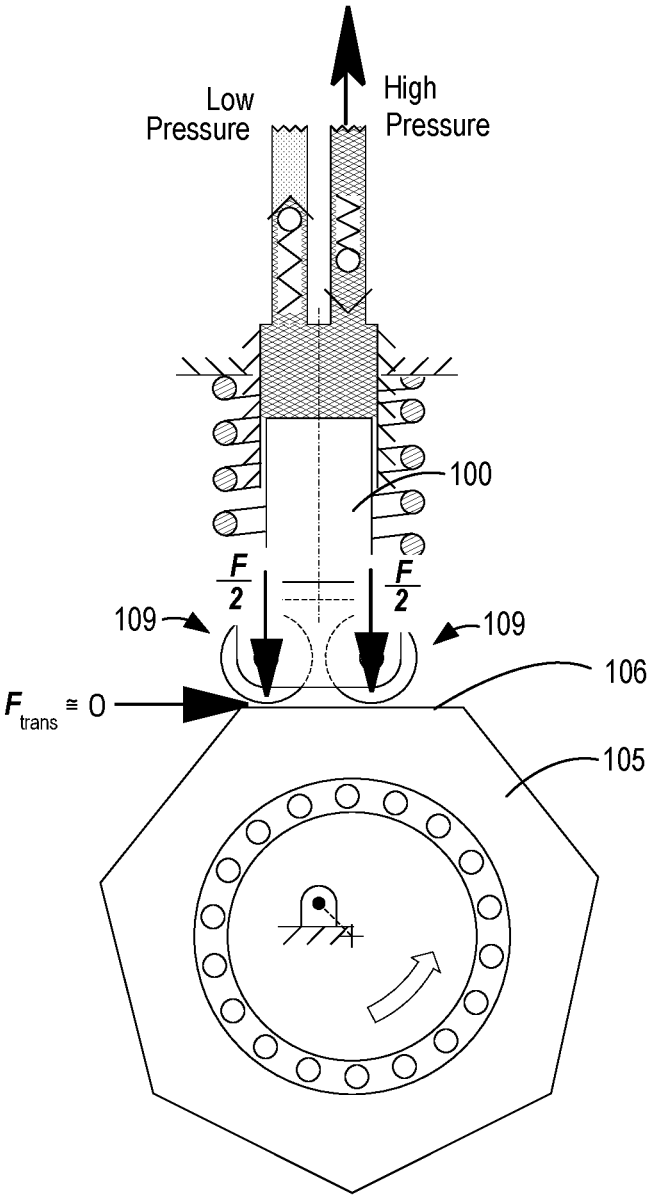

A model of the loads associated with the architecture described here is illustrated in FIG. 6. The cam followers 109 replace the sliding contact between the piston assembly and the face 106 of the cam 105 with rolling contact. As a result, the transverse forces at the contact points between the cam followers 109 and the cam 105 are near zero. Therefore, side loading on the piston 100 is nearly eliminated.

The newly proposed pump-motor architecture improves the mechanical efficiency of the pump-motor in two ways. First, the frictional loss at the point of contact between the piston 100 and the cam 105 in the sliding design of FIG. 5 is nearly eliminated. Second, the frictional losses caused by the side loads on the piston 100 are also nearly eliminated. In addition, nearly eliminating side loading on the piston 100 reduces opportunities for binding and wear on the pistons 100 and piston cylinders 107. Reducing frictional losses also means that the pump-motors will introduce less heat into their working fluids, so system cooling requirements are reduced.

The design described here has another attractive feature which is suggested in FIG. 6: the forces between the cam followers 109 and the cam tend to be self-balancing to hold the cam in the desired orientation. Note that the contacts between the cam followers 109 and the cam 105 are used to keep the cam from rotating: if either contact were removed, the cam would gain a second degree of freedom and its angular orientation would be arbitrary. Consider what would happen if the top cam face started to rotate off of horizontal in FIG. 6. Any change in angle of the cam would cause one of the contact forces between the cam followers and the cam to rise rapidly, while the other would drop rapidly. This change in force distribution will tend to rotate the cam face back to its desired horizontal position.

Figure 7:
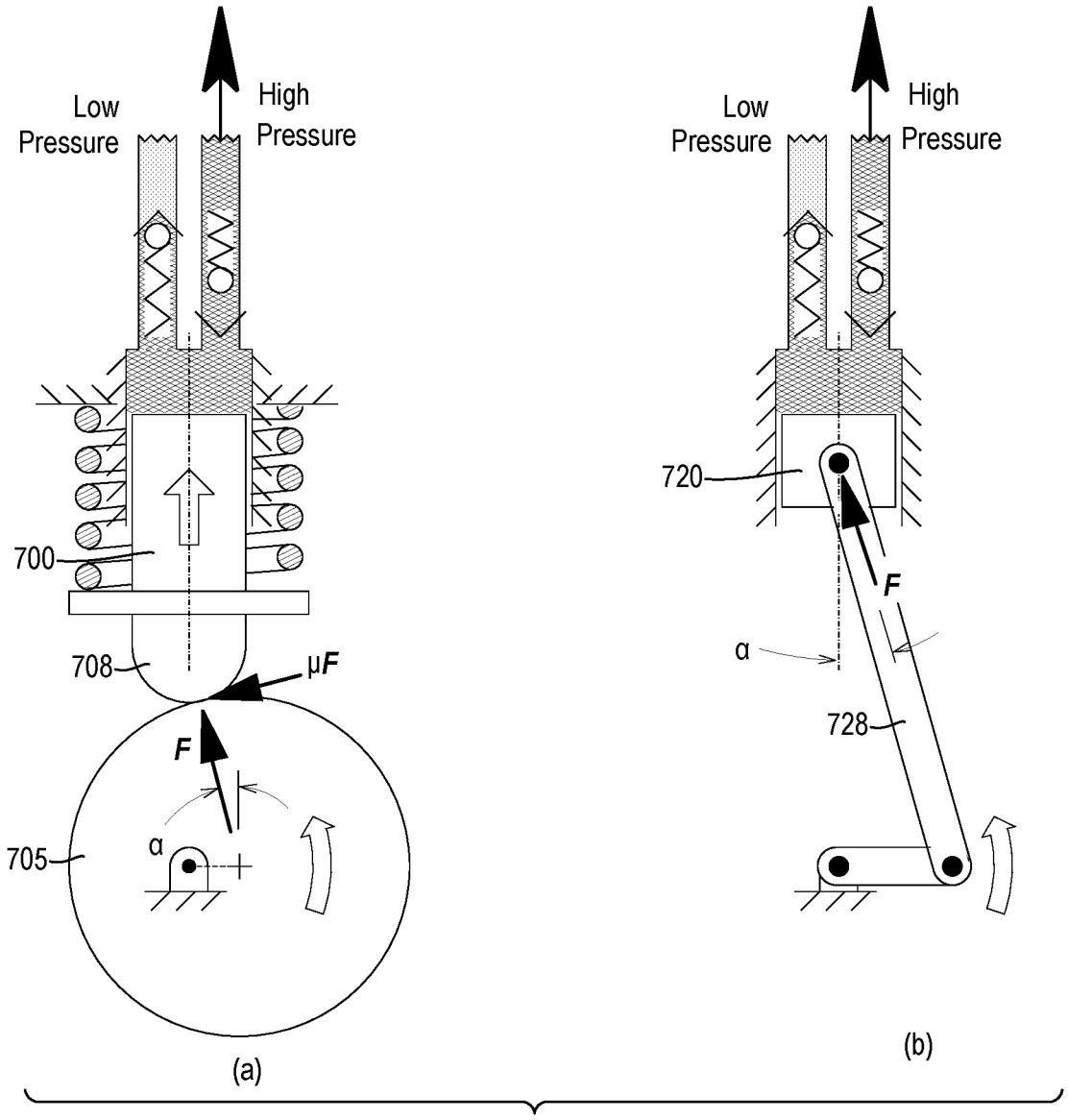

Other common alternative pump and motor architectures also produce significant side loading on the pistons. Two examples are provided in FIG. 7. The diagram in view (a) of FIG. 7 illustrates a radial pump where an eccentric cam 705 directly drives the piston 700. A load that is transverse to the direction of motion of the piston develops at the point of contact between the eccentric cam 705 and the follower 708. The transverse force has two components: one attributable to the normal force between the cam and the piston (F sin a) and another attributable to the frictional force created by the normal force (μF cos a). The transverse force develops a bending load on the piston 700 similar to that shown in FIG. 5. The diagram in view (b) of FIG. 7 illustrates a radial pump based on a slider-crank mechanism. The connecting rod 728 applies a side load to the piston 720 having a magnitude of F sin a, where a is the angle that the connecting rod 728 makes with the centerline of the piston 720.

In summary, a radial piston pump-motor architecture introduced includes the addition of two rolling cam followers between the cam and the piston to a design where a rotating eccentric drives a flat-faced translating cam. Adding the cam followers is expected to produce the lowest side loads on the pistons of any known piston pump-motor architecture. Therefore, the mechanical losses in the pump-motor are very low, and the service life of the pump-motor is increased.

In the examples described above, high pressure is applied to both the pump and the motor pistons over the full half cycles in which power is delivered, e.g., during the full upstroke during pumping and during the full downstroke when motoring. Additional embodiments described in relation to FIGS. 12-20 and 23-32 are of a high efficiency pump and motor, respectively, utilizing partial stroke piston pressurization (PSPP).

Many applications require a variable displacement pump but not a motor. The pump described herein below will automatically provide ideal timing for pressurizing and depressurizing the working fluid independent of the operating conditions. A stand-alone motor design is also described hereinbelow. The motor will automatically provide ideal timing for depressurizing the working fluid independent of the operating conditions. While the timing for pressurizing the working fluid may be ideal for only a single operating condition, the timing will remain close to ideal for a reasonable range of operating conditions. The pump and motor technologies described here can be combined to yield a combination pump-motor. The method for combining the pump and motor functions is briefly described hereinbelow.

A hydraulic piston pump or motor is a mechanical system that mechanically couples the up and down motion of a piston to the rotary motion of a drive shaft, and a hydraulic valving system, which controls the flow of hydraulic fluid through the piston cylinder. The embodiments described here include various hydraulic valving systems. The hydraulic valving system can be combined with a variety of existing mechanical piston pumping and/or motoring systems, including various embodiments of radial piston pumps, axial piston pumps, wobble-plate pumps, and slider-crank pumps. In the embodiments described above, a radial piston pump-motor architecture includes the addition of two rolling cam followers between the cam and the piston to an otherwise established design. Adding the cam followers is expected to produce the lowest side loads on the pistons of any known piston pump-motor architecture. Therefore, the mechanical losses in the pump-motor are very low, and the service life of the pump-motor is increased.

The hydraulic valve system disclosed below that enables PSPP is not limited to that particular mechanical system shown in FIGS. 1-4 and may be used by other piston-based pumps, motors, and pump-motors. However, the previously described radial pump shown in FIGS. 1-4 will be used as an example to demonstrate how the partial-stroke valve operates. The features described here can be thought of as an extension to an existing pump technology known as a "check ball pump." The operation of a check ball pump is reviewed here in more detail.

Recall that the implementations shown in FIGS. 1-4 typically contain 6-8 piston/cylinder pairs, although more or fewer may be used. In reference again to FIG. 2, torque is applied about the center of rotation of a drive shaft (not shown) by an external power source. An "eccentric" 101 includes a cylinder that is rigidly attached to the drive shaft and whose center is offset from the center of rotation 102 of the driving shaft. The geometric center 104 of the eccentric 101 describes a circle 120 about the center of rotation of the drive shaft as the drive shaft is rotated 360°. The circle has a radius equal to the distance of the offset between the center of rotation 102 of the drive shaft and the center 104 of the eccentric 101.

The "cam" 105 is a body with an outer face that is an equilateral polyhedron and an inner face that is a simple cylinder. The number of faces of the polyhedron normally matches the number of pistons 100 in the pump, with each face 106 driving a single piston 100. The cam 105 shown in these examples is designed to drive seven piston-cylinder pairs. The center of the inner cylindrical face is concentric with the center of the polyhedron.

A bearing 103 is included between the outer cylindrical face of the eccentric 101 and the inner cylindrical face of the cam 105. The bearing 103 allows relative rotation between the eccentric 101 and the cam 105. As the drive shaft rotates, the eccentric 101 also rotates, but the cam 105 does not: it simply translates. As the drive shaft is rotated 360°, every point on the cam 105 describes a circle 120 having the same size as that described by the center of the eccentric 101, but offset from it.

The piston 100 is rigidly mounted to a translating carriage assembly 108. Two cam followers 109 are connected to the base of the carriage assembly 108 using pin, or revolute, joints. The cam followers 109 can freely rotate about their center axes. A return spring or biasing element 110 is positioned between the frame/case of the pump and the piston carriage assembly 108. The return spring or biasing element 110 causes both cam followers 109 to press against one of the polyhedral faces 106 on the outside of the cam 105.

The piston cylinder 107 constrains the piston 100 to move in a simple, one-dimensional translating motion in the plane of motion of the eccentric 101 and cam followers 109. If the drive shaft is rotated at a constant velocity, the piston 100 travels in the cylinder in sinusoidal up-and-down motion ("cycloidal" motion).

Two check valves 114, 116 control the flow of hydraulic fluid into and out of the piston cylinder 107 in a check ball pump. A low pressure check valve 114 is positioned between the low pressure supply 115 and the piston cylinder 107. The low pressure check valve 114 is oriented so that it allows hydraulic fluid to flow into the piston cylinder 107 from the low pressure supply 115, but it prevents hydraulic fluid from flowing out of the piston cylinder and back into the low pressure supply. A high pressure check valve 116 is positioned between the piston cylinder 107 and the high pressure supply 117. The high pressure check valve 116 is oriented so that it allows hydraulic fluid to flow out of the piston cylinder 107 and into the high pressure supply 117, but it prevents hydraulic fluid from flowing into the piston cylinder 107 from the high pressure supply 117.

Figure 8:
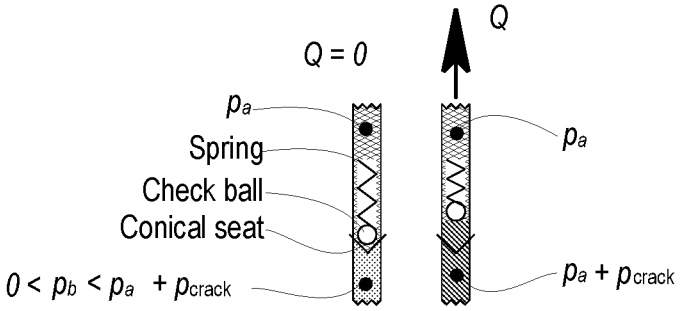
FIG. 8 is a schematic diagram of a ball check valve used in a pump-motor according to an example embodiment.

A check ball pump derives its name from the common practice of implementing the check valves with spherical balls that seal against conical seats (see FIG. 8). Many alternative check valve implementations exist, such as disc check valves and poppet check valves. Alternative check valve embodiments could be used in place of the check ball embodiment shown. All of these valves at least include a blocking member (e.g., ball, poppet, disc) that moves against a seat (e.g., conical seat, ridge) in order to block fluid from flowing through the valve.

For the ball check valve, if fluid pressure above the conical seat, $p_a$, is higher than that below the conical seat, $p_b$, the fluid pressure pushes the ball into the seat and prevents the flow of fluid through the valve (left side of FIG. 8). If the fluid pressure below the conical seat is higher than that above the conical seat, the fluid pressure pushes the ball out of the seat and fluid flows through the valve (right side of FIG. 8).

A biasing element, such as a spring, is commonly used to ensure that the blocking member returns to its seat when the fluid pressure above the seat rises above the fluid pressure below the seat. The fluid pressure differential required to unseat the blocking member, which enables fluid to flow through the valve, is called the "cracking pressure", $p_{crack}$, of the valve. The value of $p_{crack}$ is small (e.g., on the order of one bar) in a well-designed valve.

The "displacement" of one piston-cylinder pair of a pump or motor is typically taken as the volume of fluid displaced by translating the face area of the piston through its full range of motion. Typically, when the piston is at top dead center, a volume of fluid still exists between the top of the piston and the check valve seats. This fluid volume is called the "dead volume." The "working volume" is defined here as the total volume of fluid between the top of the piston and the check valve seats for any position of the piston. When the piston is at top dead center, the working volume is the same as the dead volume. When the piston is at bottom dead center, the working volume comprises the displacement plus the dead volume. Minimizing the dead volume improves the efficiency of the pump. The "displacement" of the pump or motor is typically taken as the aggregate displacement of all of the piston-cylinder pairs comprising the pump or motor.

The operation of one cylinder of a check ball pump through one full revolution of the drive shaft is represented in FIGS. 3 and 4. The angle of the drive shaft, θ, is arbitrarily defined to be 0° when the piston is at bottom dead center (BDC). When θ=180°, the piston is at top dead center (TDC).

The drive shaft is assumed to rotate in the counterclockwise direction in FIGS. 3 and 4. A check ball pump will pump equally well if the drive shaft is rotated in the clockwise direction. If the drive shaft is rotated in the clockwise direction, the relationship between the drive shaft angle and fluid flow direction illustrated in FIGS. 3-4 will be reversed.

Views (a) to (e) in FIG. 3 represent the motion of the piston as it moves from BDC to TDC. This portion of the cycle is called the "pumping stroke." Upward motion of the piston raises the pressure of the working volume of fluid. When the pressure of the fluid in the cylinder rises above the pressure of the fluid in the high pressure line, plus the cracking pressure, the high pressure check valve opens and fluid is pumped into the high pressure line.

Views (a) to (e) in FIG. 4 represent the motion of the piston as it moves from TDC to BDC. This portion of the cycle is called the "return stroke." Downward motion of the piston lowers the pressure of the fluid. When the pressure of the fluid in the cylinder falls below the pressure of the fluid in the low pressure supply, minus the cracking pressure, the low pressure check valve opens and fluid is drawn into the working volume of the cylinder.

A subtlety of the operation of a check ball pump is that the high pressure check valve does not open at BDC as the pumping stroke is initiated. While hydraulic fluid is commonly modeled as incompressible, it actually has a small amount of compressibility, especially if the fluid contains entrained air. As a result, the piston must rise a small amount to sufficiently compress the fluid to raise its pressure to that of the high pressure line, plus the cracking pressure of the high pressure check valve, before the high pressure check valve opens. Therefore, the high pressure check valve does not open until a few degrees of rotation of the drive shaft past BDC.

Similarly, the low pressure check valve does not open exactly at TDC. As the drive shaft moves the piston past TDC, the piston starts to move downward and decreases the pressure of the working volume of fluid. The high pressure check valve closes as soon as the fluid pressure in the cylinder drops by the cracking pressure of the check valve. However, the low pressure check valve does not open until the pressure of the working volume of fluid drops below the pressure of the fluid in the low pressure supply minus the cracking pressure of the low pressure check valve. This typically requires a few degrees of rotation of the drive shaft past TDC.

The delay of the opening of the high pressure check valve until the drive shaft has rotated past BDC, and the delay of the opening of the low pressure check valve until the drive shaft has rotated past TDC, causes check ball pumps to operate very efficiently. The reason is that the pressure difference across the check valves is approximately only $p_{crack}$ as fluid flows through the valves, so very little energy is lost to throttling.

The crank angles at which a check valve opens or closes defines the "valve timing." Another benefit of check ball pumps is that the valve timing self-adjusts to maintain high efficiency for different operating pressures, speeds and fluid properties. For example, consider the case where the pressure of the high pressure supply is increased. The pressure of the fluid in the working volume must be raised further before the high pressure check valve will open. As a consequence, the crank will rotate slightly farther past BDC before the high pressure check valve opens. But the pressure drop across the check valve nominally remains at $p_{crack}$, and the throttling loss remains low. In contrast, if the valve timing were fixed, the pressure drop across the high pressure valve would be greater for one operating pressure than the other, resulting in a higher throttling loss at one of the two operating points.

The check ball pump described in FIGS. 1-4 is a fixed displacement pump; e.g., it will always displace the same volume of fluid for one full rotation of the drive shaft. In contrast, the pump architecture described below is a variable displacement pump; e.g., it can vary the volume of fluid displaced per revolution of the drive shaft from zero to the displacement of an equivalent check ball pump having the same piston diameter and piston travel. The hydraulic valving system described below preserves the high efficiency valving attributes of the check ball pump.

Figure 9:
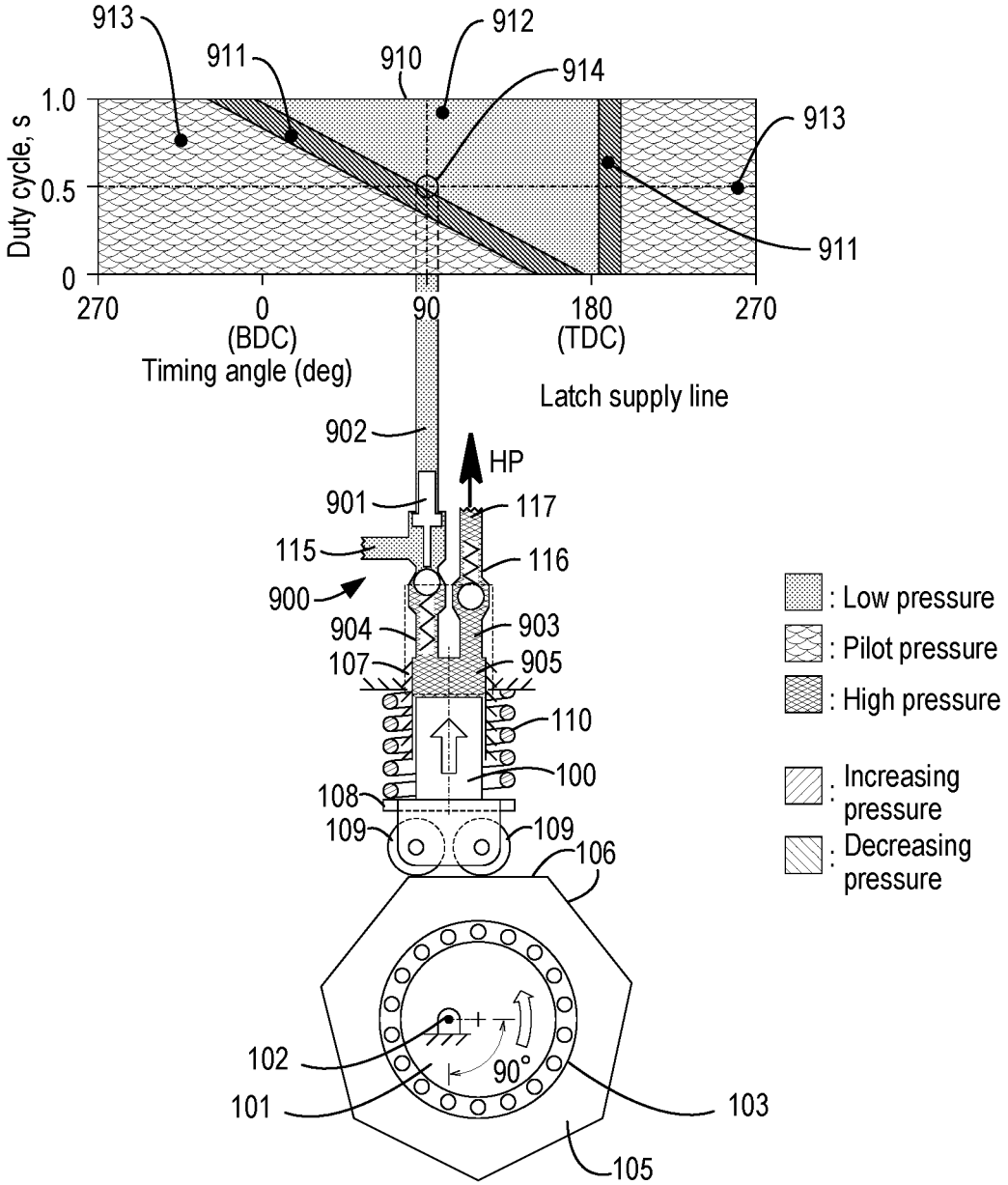
FIG. 9 is a diagram of a pump according to an example embodiment.

The terminology associated with the pump architecture disclosed here is introduced in FIG. 9. The terminology for the mechanical portion of the pump system is similar to that defined in FIG. 2, and the same reference numbers will be used to identify those similar components. While the schematic representation of the high pressure check valve 116 in FIG. 9 is slightly different than that shown in FIG. 2, its function is similar to that shown in FIG. 2. The high pressure check valve 116 is coupled to the cylinder 107 via a high pressure port 903.

The low pressure check valve from FIG. 2 has been replaced by a low pressure "latching check valve" 900. The latching check valve 900 is coupled to (e.g., in fluid communication with) the cylinder 107 via a low pressure port 904. A portion of the working volume of fluid 905 moves in and out through the ports 903, 904 during operation of the pump. The "latch" of the latching check valve 900 includes a hydraulically actuated piston 901 (referred to herein as a latch piston or actuator piston) that can force the check valve to remain in the open position, even if fluid flows through the valve 900 in the direction that would normally close it. The position of the latch piston 901 is determined by the pressure of a fluid in a separate hydraulic piston line (latch supply line 902) which feeds it. Descriptions herein of a "supply line" are not meant to imply a particular direction of flow, only that fluid may be supplied along the supply line in either or both directions. For purposes of this disclosure, the state of the latching check valve wherein the latch piston holds the blocking member of the check valve away from the seat so that fluid may pass through the valve in either direction is also referred to as a bypass state. Note that the latch piston 901 need not be a single piece. For example, the piston 901 may be formed of two or more discrete pieces, e.g., a piston portion that is driven by the latch supply line and an actuating portion (e.g., pin) that holds the blocking member (e.g., ball) of the valve away from its seat in response to movement of the piston portion.

The fluid driving the latch piston 901 can either be at low pressure or "pilot pressure," where pilot pressure is an intermediate pressure state that may vary between low pressure and high pressure. Typically, "low pressure" falls in the range 0-10 bar gauge, "high pressure" falls in the range 70-350 bar gauge, and "pilot pressure" falls in the range 7-20 bar gauge. In some embodiments, pilot pressure may be the same as high pressure, although raising pilot pressure to the level of the high pressure supply will result in increased leakage through the latching check valve control system.

Figure 10A:
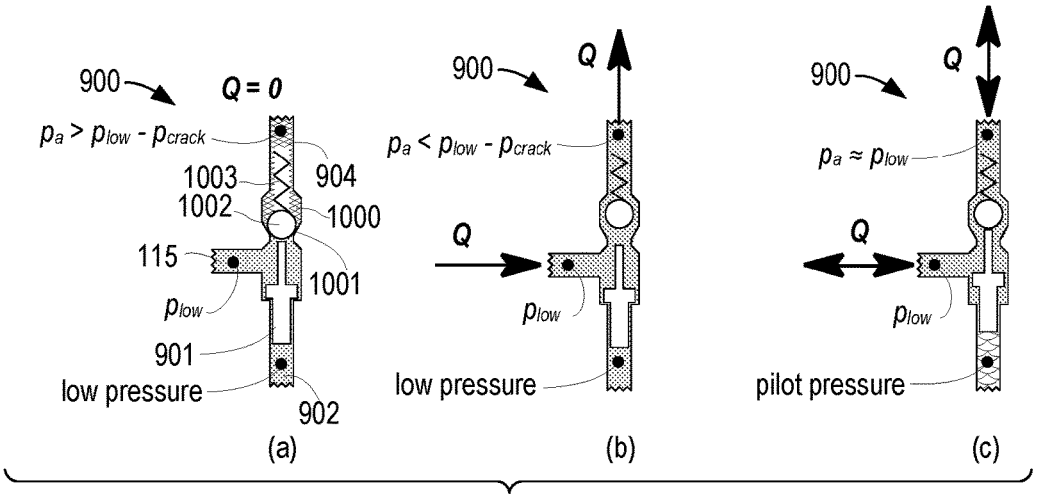
FIGS. 10A and 10B are schematic diagrams of latching check valves according to various embodiments.

The operating states of the latching check valve 900 are illustrated in FIG. 10A. As seen in this figure, the latching check valve 900 includes a center cavity 1000 in fluid communication with the low pressure port 904. A seat 1001 is located between the low pressure supply 115 and the center cavity 1000. A blocking member 1002 is biased via biasing element 1003 to move towards the seat 1001 and to block flow therethrough when the pressure in the cylinder and low pressure port (which will be at approximately the same pressure as the cylinder) is above the low pressure. An actuator piston (in this case the latch piston 901) is linearly displaceable to bypass the blocking member 1002 in a bypass state of the latching check valve 900. The latch piston 901 is driven by a latch supply line 902.

If the fluid pressure in the latch supply line 902 is low, the latching check valve 900 operates identically to a conventional check valve (views (a) and (b) in FIG. 10A). If the pressure in low pressure port 904, $p_a$, drops below the low pressure minus the cracking pressure, $p_{crack}$, the check valve will open and be in the state illustrated in FIG. 10A, view (b). However, if the latching check valve 900 is in the open position, pilot pressure can be introduced to the latch supply line 902 to latch the blocking member 1002 (e.g. check ball) in the open position (view (c) in FIG. 10A). When latched open, hydraulic fluid can flow through the latching check valve in either direction.

The pump and motor systems described here are designed such that pilot pressure will be applied to the check valve latch piston 901 in FIG. 10A only after the check valve 900 has been opened by fluid flowing from the low pressure line 115 into the piston cylinder 107. If pilot pressure were applied to the check valve latch piston 901 while the check valve 900 was closed, the latch piston 901 may or may not be capable of opening the valve, depending on the magnitude of the pilot pressure relative to high pressure, the fully open area of the check valve orifice and the diameter of the latch piston. However, the rotary valve profiles (described in detail below) are designed so that pilot pressure should never be applied to the latch piston 901 while the check valve 900 is closed.

Figure 11:
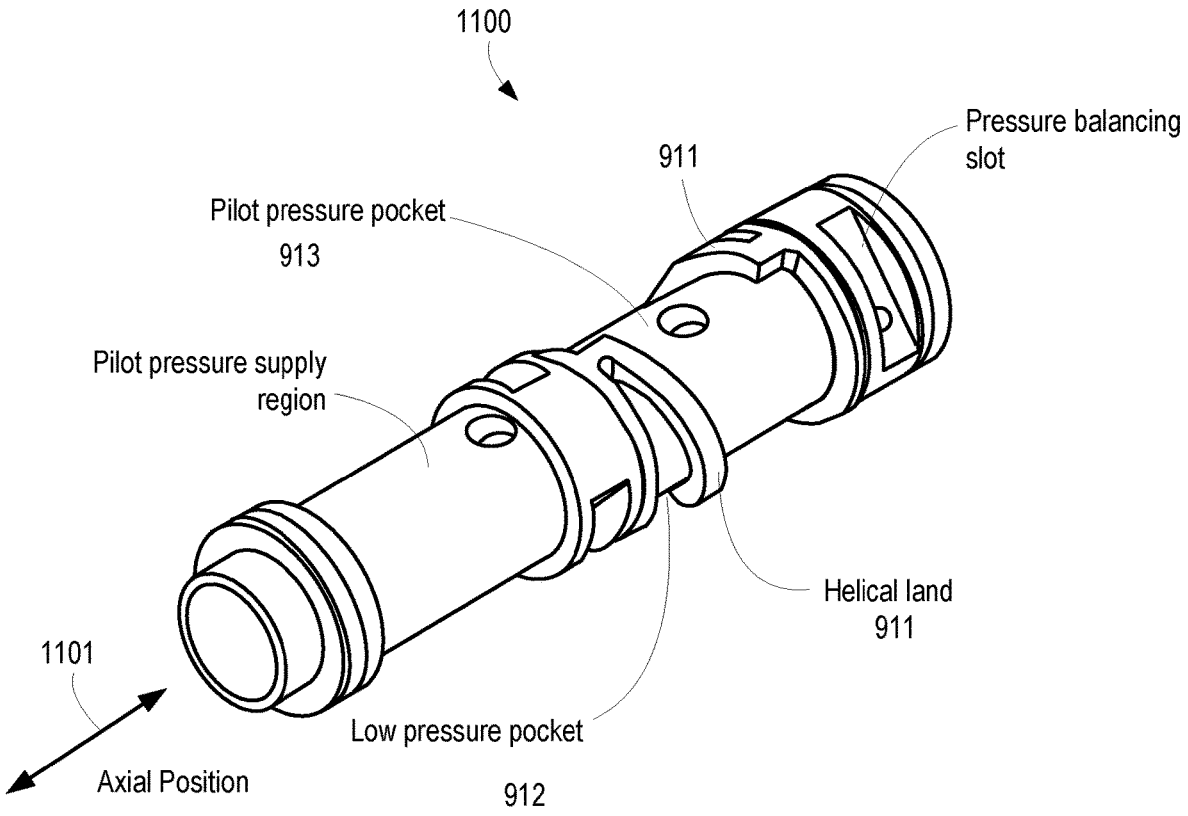
FIG. 11 is a diagram of a spool of a rotary valve according to an example embodiment.

In order to drive the valves, a rotary valve with design and function very similar to the rotary valve described in U.S. Pat. No. 10,738,757 can be used. A representation of a spool 1100 of a rotary valve is illustrated in FIG. 11, which shows the land 911 wrapped around the spool 1100. The spool 1100 rotates relative to a cylindrical sleeve (not shown) continuously while the driving shaft of the pump is rotating. The axial position 1101 of the spool 1100 relative to the sleeve sets the duty cycle of the pump. For purposes of this disclosure, "duty cycle" is meant to describe the amount of fluid displaced at high pressure per each full cycle (or stroke) of one piston-cylinder pair. It can be expressed as a dimensionless variable, that is a ratio or percentage of the actual amount of fluid displaced relative to a maximum possible displacement of a given piston and cylinder combination. For example, a duty cycle of 1 for a pump represents a state where high pressure fluid is delivered to the load for the entire upstroke of the piston (minus the portion of the upstroke required to compress the fluid from low pressure to high pressure), and a duty cycle of 0 represents a state where no high pressure fluid is delivered to the load for the entire upstroke of the piston. The valve lands 911 for the devices described here may have some differences from that shown in FIG. 11. It is noted that the "helical" profile of the valve lands 911 may be only approximately helical; the profile might be adjusted to improve the linearity of pump displacement with axial position 1101 or other goals. One or more pressure balancing slots or pockets may be included on the rotary valve to balance forces applied to the spool by the hydraulic pressures applied to it.

The spool 1100 of the rotary valve is represented in timing diagram 910 of FIG. 9 by "unwrapping" its circumferential profile onto the plane of the page. The lands 911 of the spool 1100 have an outer diameter approximately equal to the inner diameter of the sleeve within which the spool 1100 rotates. The outer diameter of the lands 911 is made very slightly less than the inner diameter of the sleeve so that the spool 1100 is able to rotate, but with minimal leakage between the tops of the lands 911 and the sleeve. Two independent pockets 912, 913, having smaller outer radii than the lands 911, exist between the lands 911 on the circumferential face of the valve spool 1100. A pilot pressure pocket 913 is supplied with fluid raised to pilot pressure. A low pressure pocket 912 is supplied with fluid at the low pressure.

The sleeve of the rotary valve contains an orifice 914. The orifice ports hydraulic fluid at either low pressure or pilot pressure through a fluid passage (latch supply line 902) to the latching check valve latch piston 901. When the rotary valve directs fluid at low pressure to the low pressure check valve latch piston 901, the low pressure check valve 900 operates as a simple check valve (see views (a) and (b) of FIG. 10A). When the rotary valve directs fluid under pilot pressure to the low pressure check valve latch piston 901, the check valve 900 is latched open, and hydraulic fluid can flow through the check valve 900 in either direction (view (c) in FIG. 10A).

Figure 10B:
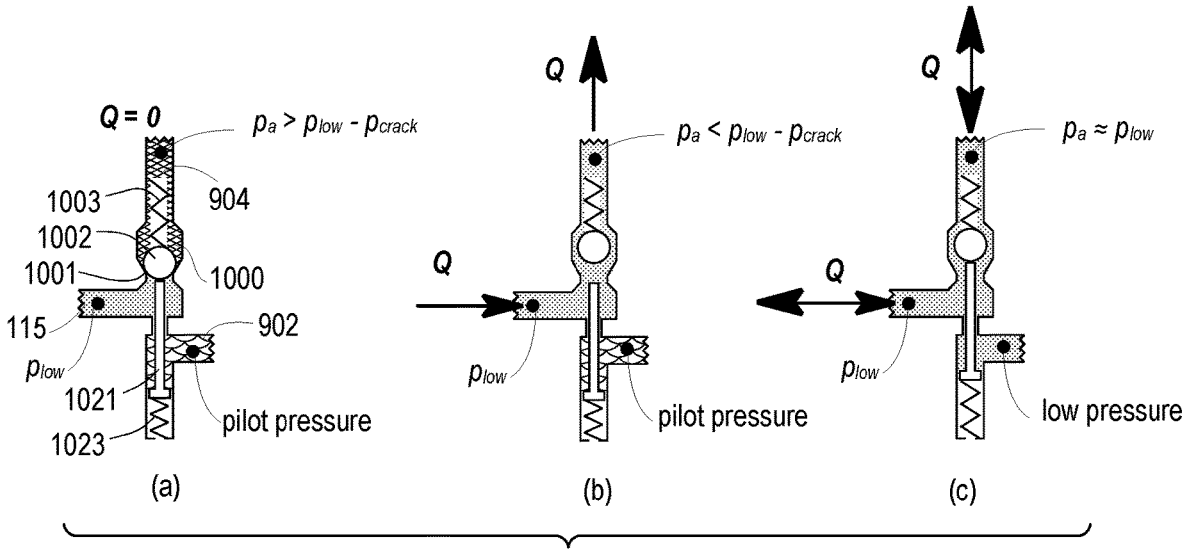

Another embodiment of the latching check valve is illustrated in FIG. 10B. In this embodiment, biasing element 1023 is sized to apply a larger force to latch piston 1021 than biasing element 1003 applies to blocking element 1002 of the check valve. Therefore, if low pressure is applied to latch supply line 902, and the pressure in low pressure port 904 allows, the latch piston 1021 will latch the blocking member 1002 of the check valve in the bypass state, as illustrated in FIG. 10B, view (c). The cylinder for latch piston 1021 is designed to apply the pressure in latch supply line 902 to the rod side of the piston. Applying pilot pressure to latch supply line 902 causes latch piston 1021 to overcome the biasing force of biasing element 1023 and retract, as illustrated in views (a) and (b) of FIG. 10B. Therefore, applying pilot pressure to latch supply line 902 causes the latching check valve to operate as a conventional check valve, while applying low pressure to latch supply line 902 causes the latching check valve to maintain the bypass, or latched, state. In either case illustrated in FIG. 10A or FIG. 10B, a changing of the pressure at the latch supply line 902 from low to pilot pressure (in the case of FIG. 10A) or from pilot pressure to low pressure (in the case of FIG. 10B) would cause the bypass state of the latching check valve 900 to be maintained.

In a pump having more than one piston, every cylinder is individually outfitted with a rotary valve orifice 914, a latching check valve 900, and a high pressure check valve 116. However, only one rotary valve is used to control all of the latching check valves 900 of a multi-piston pump.

The rotary valve has two degrees of freedom. The first degree of freedom includes its angular position while rotating around its axis. Different angular positions of the valve are represented in the timing diagram 910 of FIG. 9 by sliding the valve profile horizontally (e.g., left or right) to align the rotary valve orifice 914 with different timing angles. When the rotary orifice 914 passes from one pocket 912, 913 to the other in this diagram, this will be referred to as a change of pressure to the latch supply line 902. The second degree of freedom is the axial position 1101 of the valve spool 1100 in its sleeve. Different axial positions 1101 of the valve spool are represented by sliding the valve profile in the timing diagram 910 vertically (e.g., up or down) to align the rotary valve orifice 914 with different duty cycles in FIG. 9.

The angular position of the rotary valve is coupled to the angular position of the drive shaft of the pump. The timing angle of the rotary valve, shown on the horizontal axis of the timing diagram 910, corresponds to the drive shaft angle. Zero degrees is chosen to correspond to the bottom dead center position of each piston. Therefore, as the drive shaft rotates, the rotary valve profile continuously translates from right to left in the horizontal plane relative to the position of the rotary valve orifice 914 in FIG. 9.

A timing angle of 360° is identically the same as a timing angle of 0°. The motion of the rotary valve is clarified with a contiguous series of example positions in FIG. 12 through FIG. 20. These example positions assume the latching check valve architecture illustrated in FIG. 10A is used. For the check valve architecture illustrated in FIG. 10B, the pilot and low pressures in pockets 912, 913 will be reversed from what is shown in FIGS. 9 and 12-20.

The axial position 1101 of the rotary valve is set by the user or an actuator. The axial position 1101 corresponds to the duty cycle of the pump. At a duty cycle of zero, the pump moves no working fluid to the load. At a duty cycle of one, the pump transfers nominally all of the fluid displaced as the piston travels from bottom dead center (BDC) to top dead center (TDC) to the load. In reality, slightly less than the full displacement of the piston will be transferred to the load due to leakage and fluid compressibility. While this example shows a spool 1100 that translates axially relative to the sleeve, it is conceivable to build a spool/sleeve so that the spool remains at a constant axial position and the sleeve translates relative to the spool.

As will be shown in FIG. 12 to FIG. 20, at a duty cycle of 0.5, the pump will transfer nominally half of its full displacement capacity to the load. The axial position 1101 of the rotary valve where precisely 50% duty cycle is achieved will vary slightly under different operating conditions due to the self-adjusting nature of the valve timing. The operation of the device is explained for a 50% duty cycle, but the explanation is similar for any duty cycle. Any effective duty cycle between zero and one can be achieved by varying the axial position 1101 of the rotary valve. Whereas the timing angle changes continuously, the duty cycle may stay at some user- or system-prescribed set point for substantial intervals of time.

Note that the piston 100 travels the same distance regardless of the duty cycle setting. The duty cycle effectively changes the pump displacement, even though the piston travel remains the same. As will be shown in FIG. 12 to FIG. 20, pump displacement is effectively changed by varying the point between BDC and TDC where the working volume of fluid is raised to high pressure. The above method of varying pump displacement is described as "partial stroke piston pressurization" (PSPP). As described in U.S. Pat. No. 10,738,757, reducing the pressure in the piston cylinder to low pressure for portions of the piston stroke yields high pump efficiency, and doing so with a rotary valve yields a simple and robust displacement control system.

Figure 12:
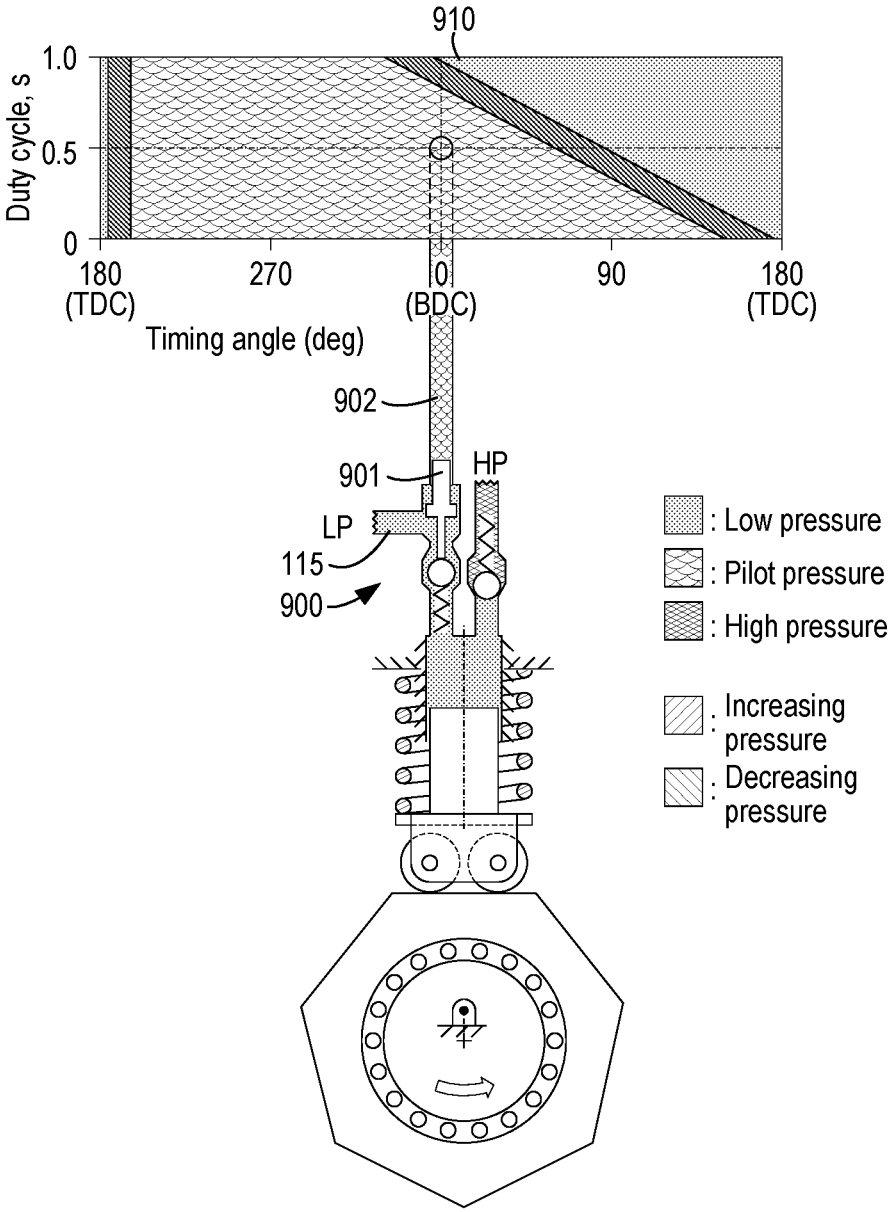
FIGS. 12-20 are schematic diagrams showing example positions of the pump shown in FIG. 9.

The piston is shown at the bottom dead center position in FIG. 12, where the piston is at the lower extreme of its motion and the working volume of fluid is maximized. The rotary valve channels fluid under pilot pressure to the low pressure check valve latch piston 901 at this position, so the low pressure check valve 900 is latched open and the working volume of fluid is connected to the low pressure supply 115.

Figure 13:
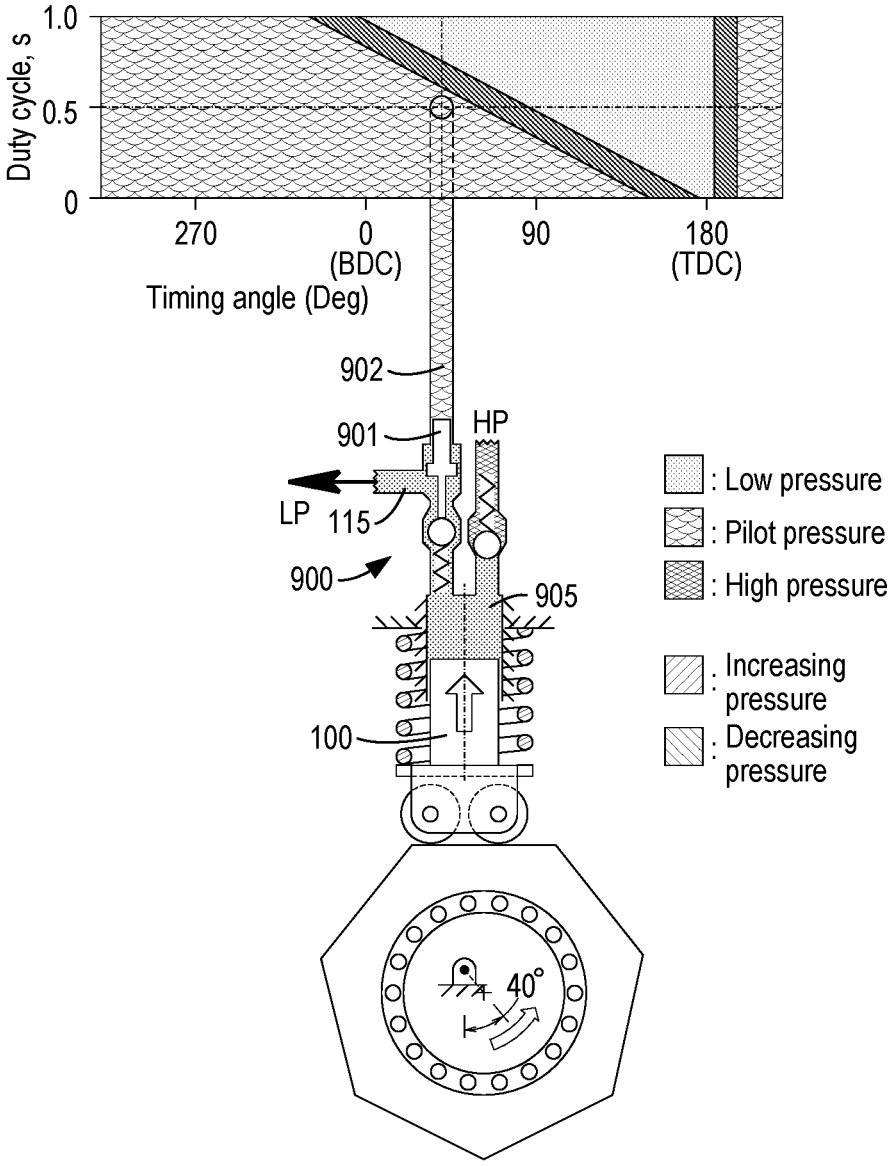

The crank is shown at a timing angle of 40° in FIG. 13. The piston 100 is traveling upward. The low pressure check valve 900 is latched open. Therefore, the working volume of fluid 905 is connected to the low pressure supply 115, and fluid in the cylinder is exhausted from the cylinder while remaining at low pressure. If the low pressure check valve 900 were not latched open, the upward motion of the piston would raise the pressure of the working volume of fluid 905, as in the simple check ball pump described above.

Figure 14:
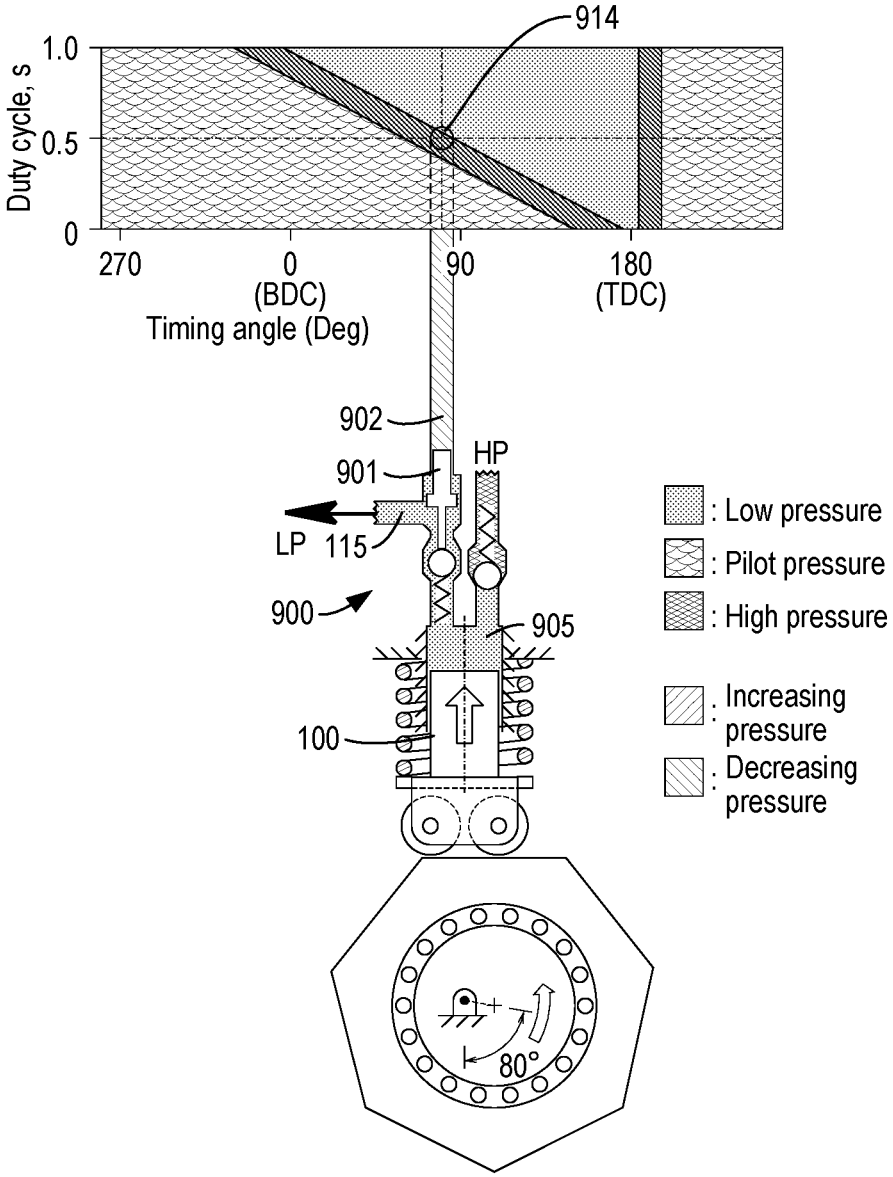

For an effective duty cycle of 0.5, the pump should start delivering pressurized fluid to the load when the piston is nominally halfway along its travel from BDC to TDC. The piston will reach that halfway point at a drive shaft angle of 90° for the pump architecture illustrated here. The diagram in FIG. 14 illustrates the state of the system as the halfway point of the piston travel is approached. The valve states are the same as those shown in FIG. 13. However, the rotary valve orifice 914 is starting to be exposed to low pressure.

A delay occurs between the time when the rotary valve first starts porting low pressure hydraulic fluid to the low pressure check valve latch piston 901 and the time that the low pressure check valve 900 fully closes. The delay occurs because a small but finite volume of fluid must be displaced out of the latch supply line 902 to retract the latch piston 901. This fluid volume is displaced through the rotary valve orifice 914.

The open area of the orifice 914 starts at zero and then increases, so the initial flow rate through the orifice 914 is near-zero. Compressibility of the fluid in the latch supply line 902 may further increase the delay. Therefore, the profile of the rotary valve is designed to send low pressure fluid to the low pressure check valve latch piston 901, and thereby initiate the closing process for the valve, slightly before the piston reaches the halfway point of its travel.

Figure 15:
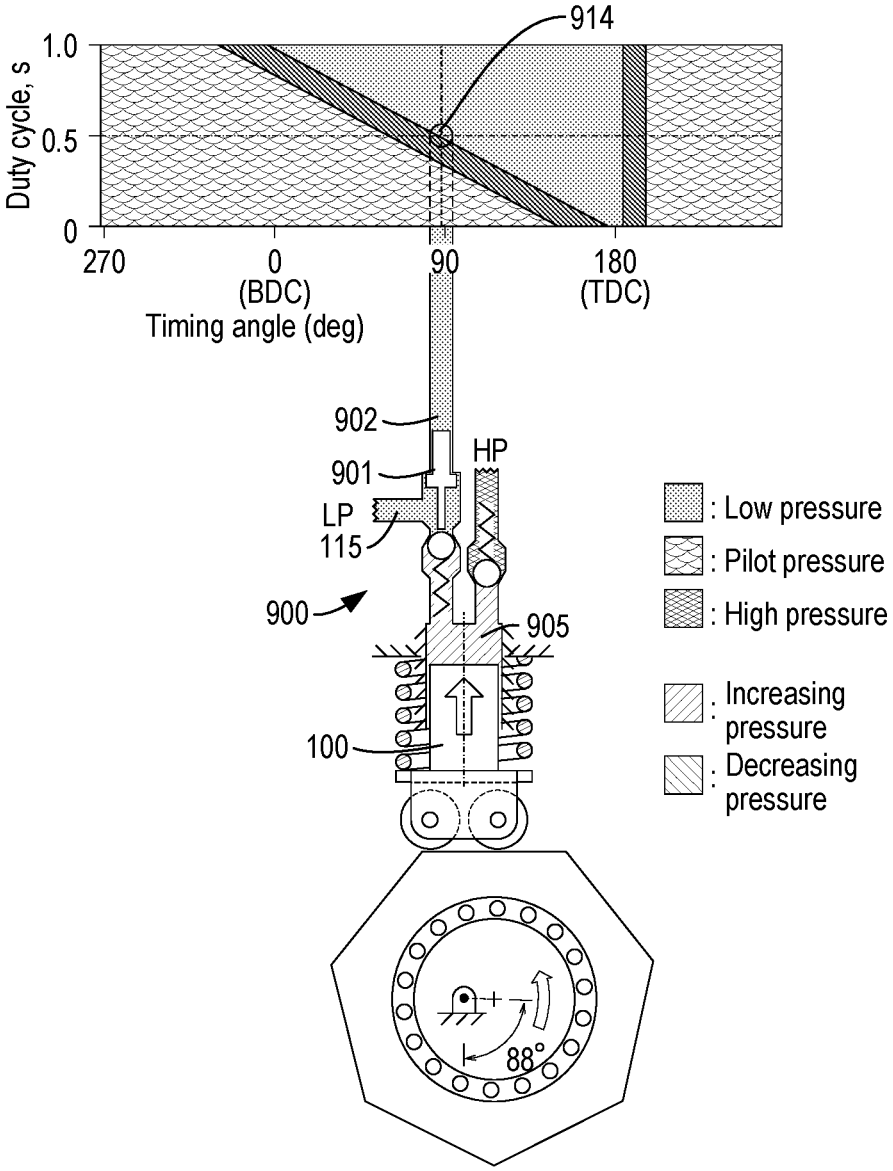

The valve timing must be further adjusted to account for the slight compressibility of the working volume of fluid. The piston 100 must travel a small distance after the latching check valve has closed to raise the working volume of fluid 905 from low pressure to high pressure. FIG. 15 illustrates a state where the latching check valve 900 has closed and the pressure of the working volume of fluid 905 is rising.

Figure 16:
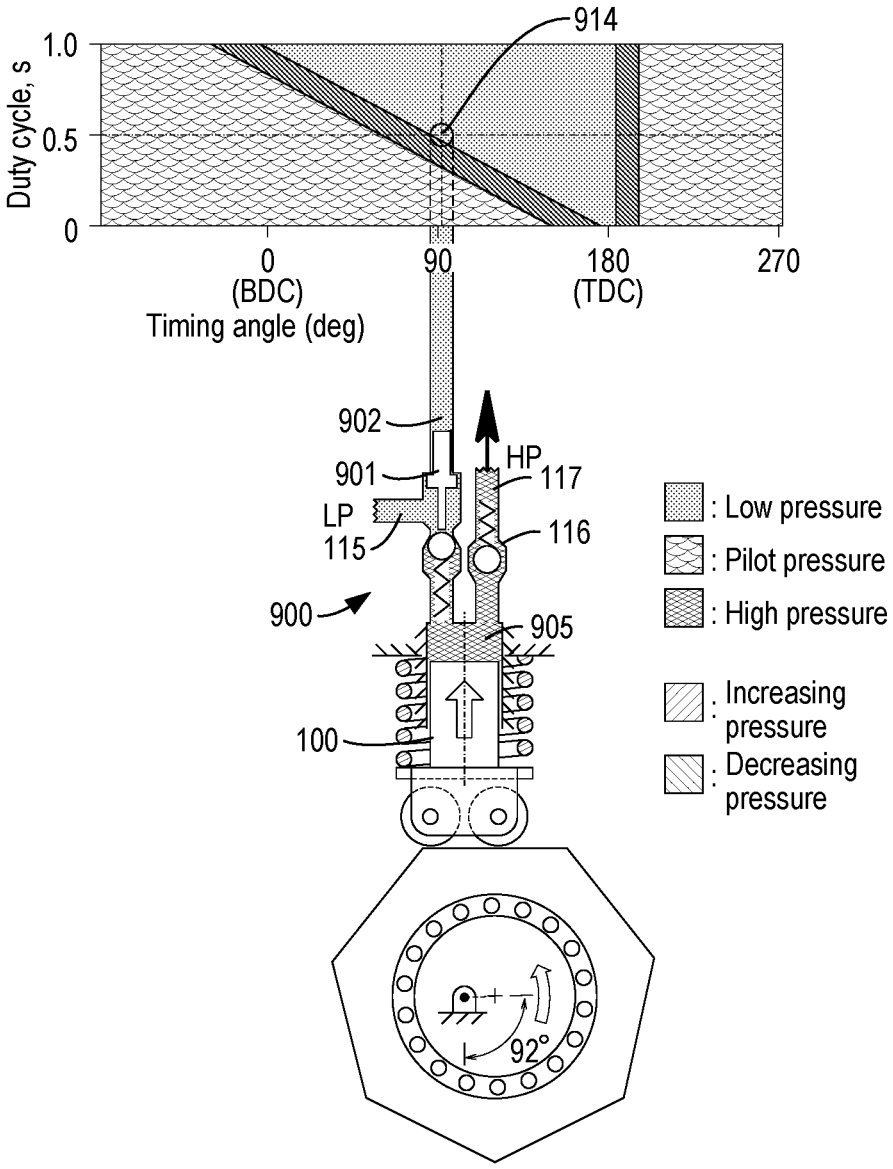

When the pressure of the working volume of fluid 905 slightly exceeds the pressure of the fluid in the high pressure line 117, the high pressure check valve 116 opens, as illustrated in FIG. 16. The pump starts sending fluid to the load at this point. Note that the check valve 116 does not open until the pressure of the working volume of fluid 905 approximately equals the pressure of the fluid in the high pressure line 117. Therefore, little throttling loss is incurred across the valve.

Figure 17:
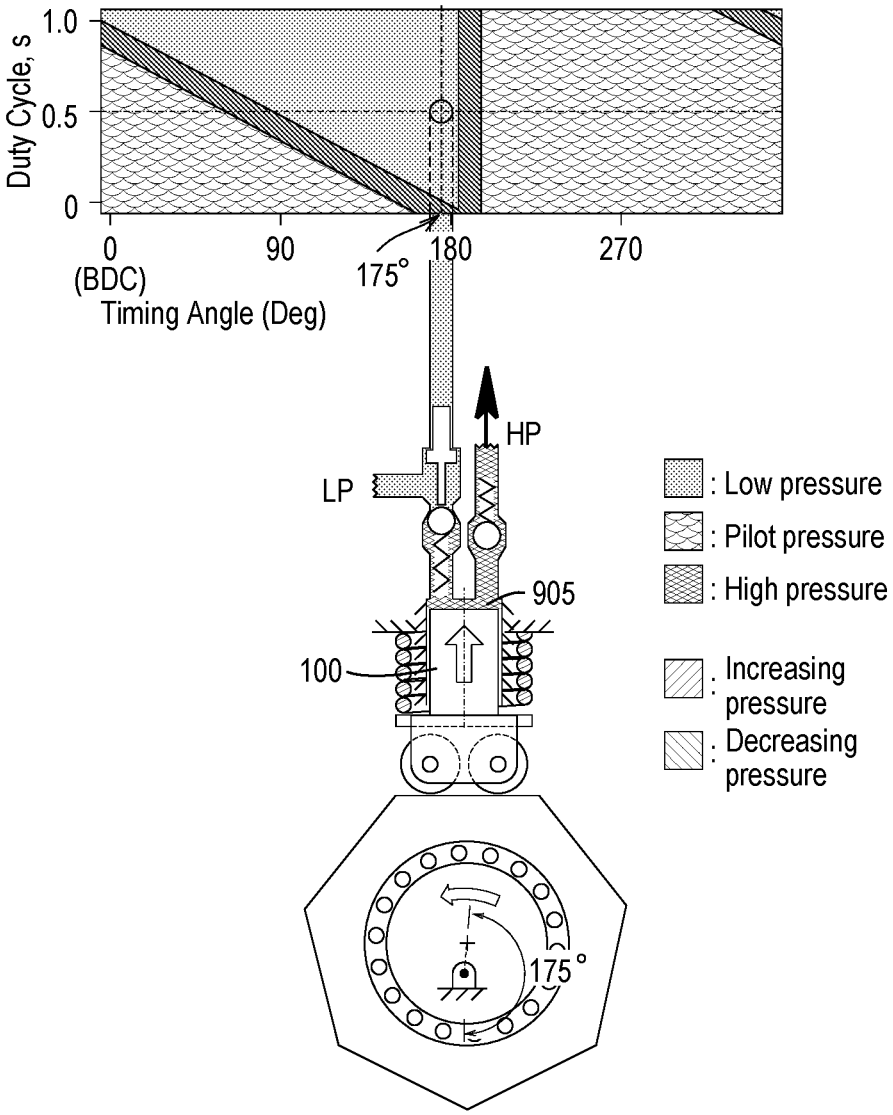

The piston 100 continues to send pressurized fluid to the load until top dead center is reached. The diagram in FIG. 17 illustrates the state of the system as TDC is approached. Note that the working volume of fluid 905 is minimized at TDC.

Figure 18:
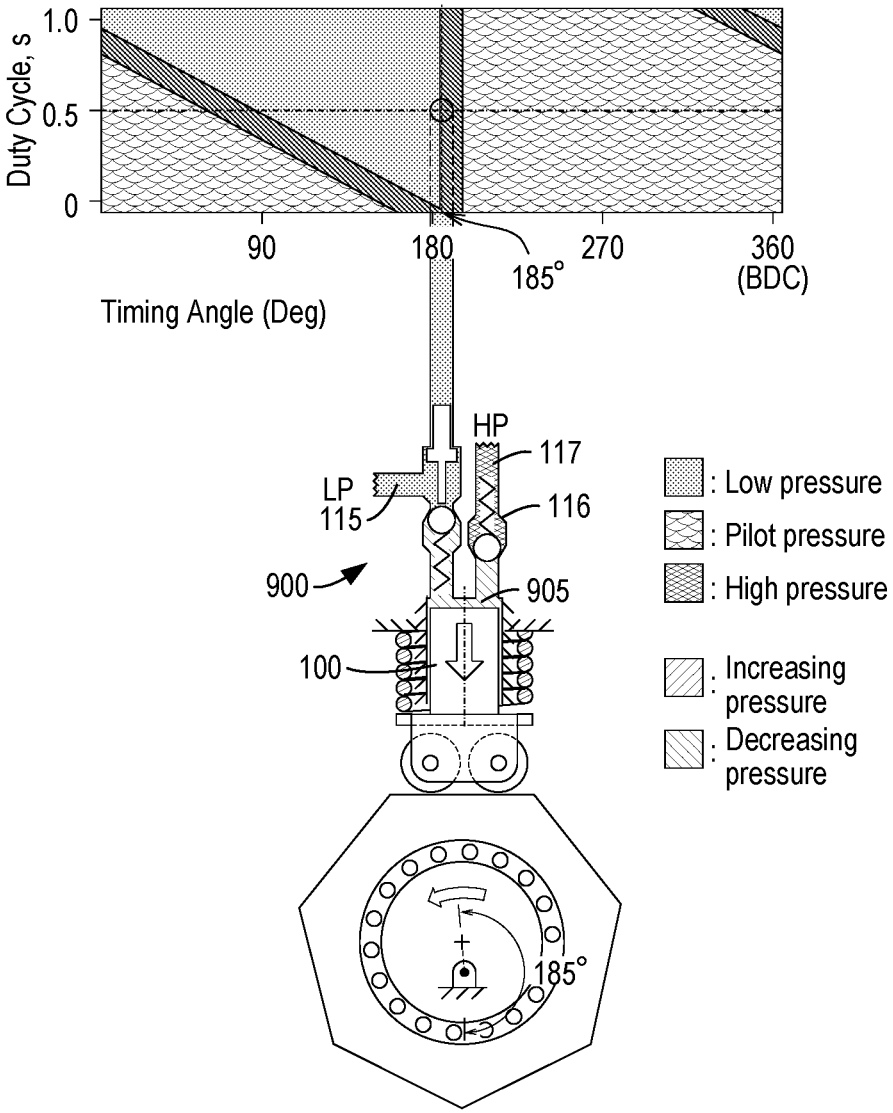

Once top dead center is passed, the pump assumes the state shown in FIG. 18. The piston 100 starts moving downward, decreasing the pressure of the working volume of fluid 905. As a result, the high pressure check valve 116 closes. However, the pressure of the working volume of fluid 905 is still greater than the low pressure supply 115, so the low pressure check valve 900 does not yet open. Since the pressurized fluid exerts a torque on the crank in the direction of its rotation, energy is briefly returned to the drive shaft while the pump is in this state.

Figure 19:
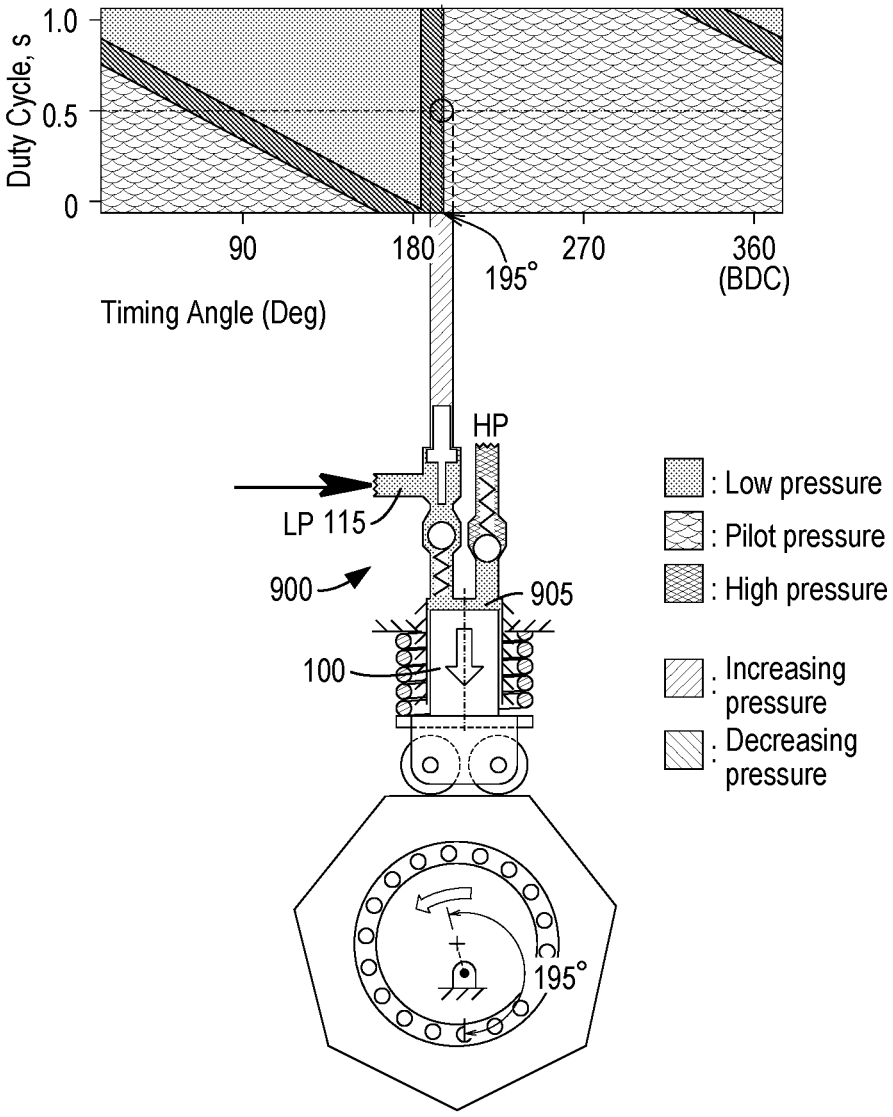

When the pressure of the working volume of fluid dips slightly below low pressure, the low pressure check valve opens, as illustrated in FIG. 19. Downward motion of the piston 100 then draws fluid from the low pressure supply 115 into the expanding working volume of fluid 905. Note that the low pressure check valve 900 ensures that the working volume of fluid 905 is not opened to the low pressure supply 115 until its pressure nominally equals the pressure of the low pressure supply 115. Therefore, little energy is lost to throttling across the low pressure check valve.

Figure 20:
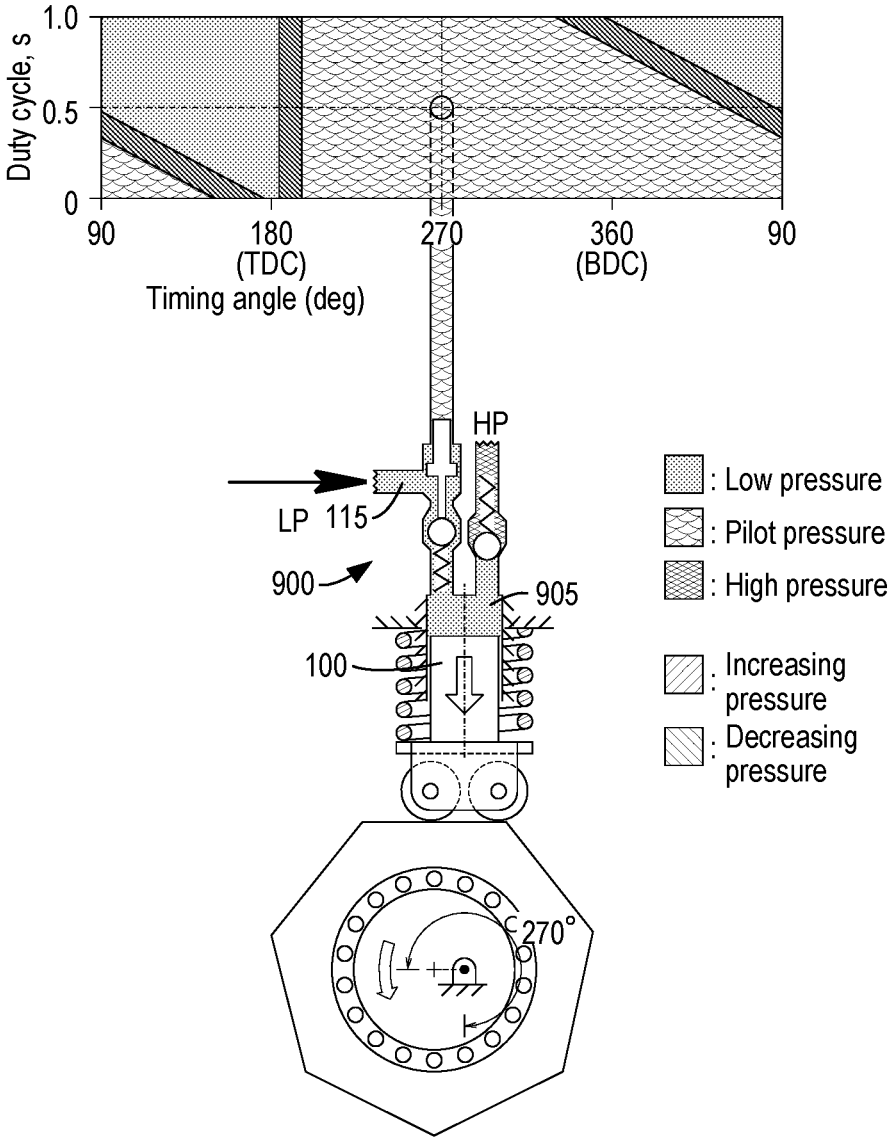

Any time after the latching check valve 900 has opened, the latching check valve 900 can be latched open by applying pilot pressure to latch supply line 902, as illustrated in FIG. 20. This application of the pilot pressure as seen in FIGS. 19 and 20 is also called a change of pressure to the latch supply line 902 that maintains a bypass state in the latching check valve 900. In this example, the change of pressure is a change from low to pilot pressure, but can be the opposite in some embodiments. The change of pressure is reversed in FIG. 14. Following the state of the pump shown in FIG. 20, the pump returns to the state illustrated in FIG. 12. The low pressure latching check valve 900 should be latched open before the piston 100 passes BDC, as the upward motion of the piston following BDC tends to pressurize the working volume of fluid 905. The rising pressure would close a conventional low pressure check valve. However, the latching check valve 900 remains open until the rotary valve ports low pressure fluid to latch supply line 902 and latch piston 901. The working volume of fluid 905 remains very close to the pressure of the low pressure supply 115 while the latching low pressure check valve 900 is latched open.

FIGS. 12-20 assume that the shaft is rotating in the counterclockwise direction. The lands on the rotary valve can be mirrored to enable operating the pump with a clockwise rotation of the shaft. A bi-directional pump can be constructed by including lands on the rotary valve to enable both counterclockwise and clockwise rotation.

Figure 21:
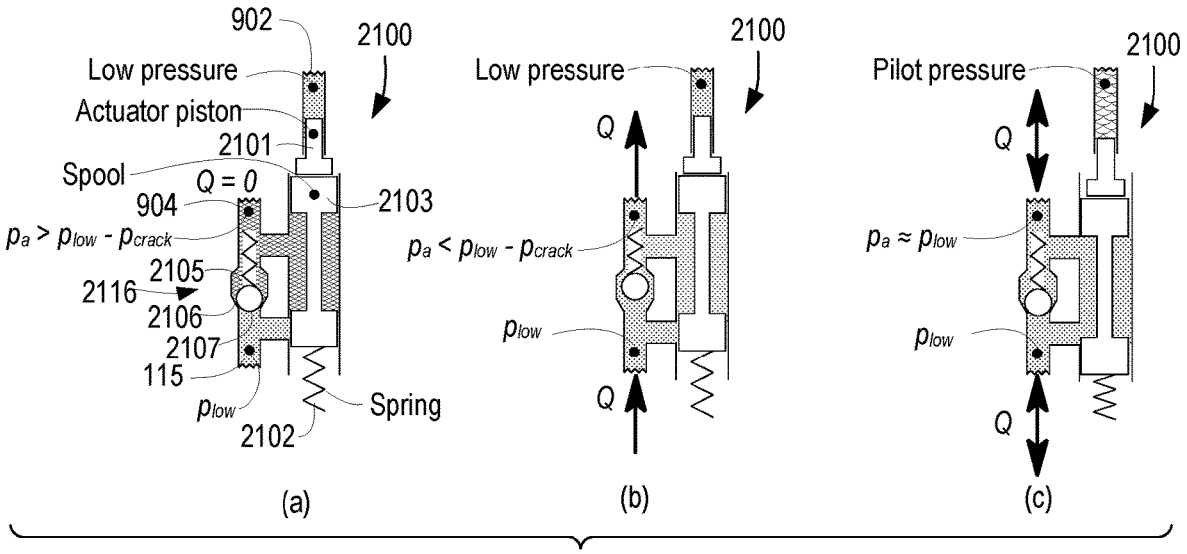
FIGS. 21 and 22 are schematic diagrams of latching check valves according to various embodiments.

In another embodiment, the function of the latching check valve can be implemented as a pilot-driven spool valve operating in parallel with a conventional check valve 2116 between the low pressure supply line 115 and the low pressure port 904 of the cylinder. A system which uses a pilot-driven spool valve 2100 is illustrated in FIG. 21. The check valve 2116 includes a center cavity 2105, a seat 2106, and a blocking member 2107. Note that while this implementation uses more than one valve, the multiple valves may still be collectively referred to herein in the singular as a latching check valve. In this embodiment, the pilot-driven spool valve 2100 provides an alternative fluid path around the check valve 2116 rather than holding the blocking member of the check valve in a position that is displaced from the check ball seat (see, e.g., FIGS. 10A and B). Nonetheless, this alternative fluid path maintains (latches) a bypass state (e.g., allows flow in either direction between low pressure supply 115 and low pressure port 904) when the latch supply line 902 changes from low pressure to pilot pressure or vice versa, therefore it functions as a latching check valve.

The spool valve 2100 is shown as a normally closed valve which is operated by an actuator piston 2101 that replaces the latch piston 901 in FIG. 10A. A discrete piston is not mandatory; the latch supply line could be connected directly to the end of the sliding spool 2103 of the valve, such that the actuator piston is integral with the sliding spool of the valve. However, the discrete piston may decrease the valve response time because it can be sized smaller than the spool valve diameter. A spring 2102, or other biasing device, pushes the spool 2103 to the closed position when low pressure is supplied to the spool valve piston 2101. The check valve 2116 then operates in the normal manner, as illustrated in views (a) and (b) of FIG. 21 and FIG. 8. If pilot pressure is supplied to the piston 2101 which opens the spool valve, the spool valve connects the low pressure supply 115 to the low pressure port 904 (see view (c) of FIG. 21). In this case, check valve 2116 is bypassed and fluid can flow between the low pressure supply 115 and the low pressure port 904 in either direction. Note that the latching check valve alternative illustrated in FIG. 10A has the benefits of fewer parts and smaller size.

Note that in the embodiment shown in FIG. 21, the coupling of the pilot pressure supply to the spool valve actuator piston 2101 causes the spool valve 2100 to bypass the check valve 2116 during a first part of an upstroke of the piston. Coupling of the low pressure supply to the spool valve actuator piston 2101 causes the check valve 2116 to control the flow of fluid between the low pressure supply and the cylinder. However, the spool valve 2100 may be configured oppositely. Namely, the spool valve 2100 may be configured such that coupling the low pressure supply to the spool valve actuator piston 2101 causes the spool valve 2100 to bypass the check valve 2116 during a first part of an upstroke of a piston. In this configuration, coupling of the pilot pressure supply to the spool valve actuator piston 2101 causes the check valve 2116 to control the flow of fluid between the low pressure supply and the cylinder.

Figure 22:
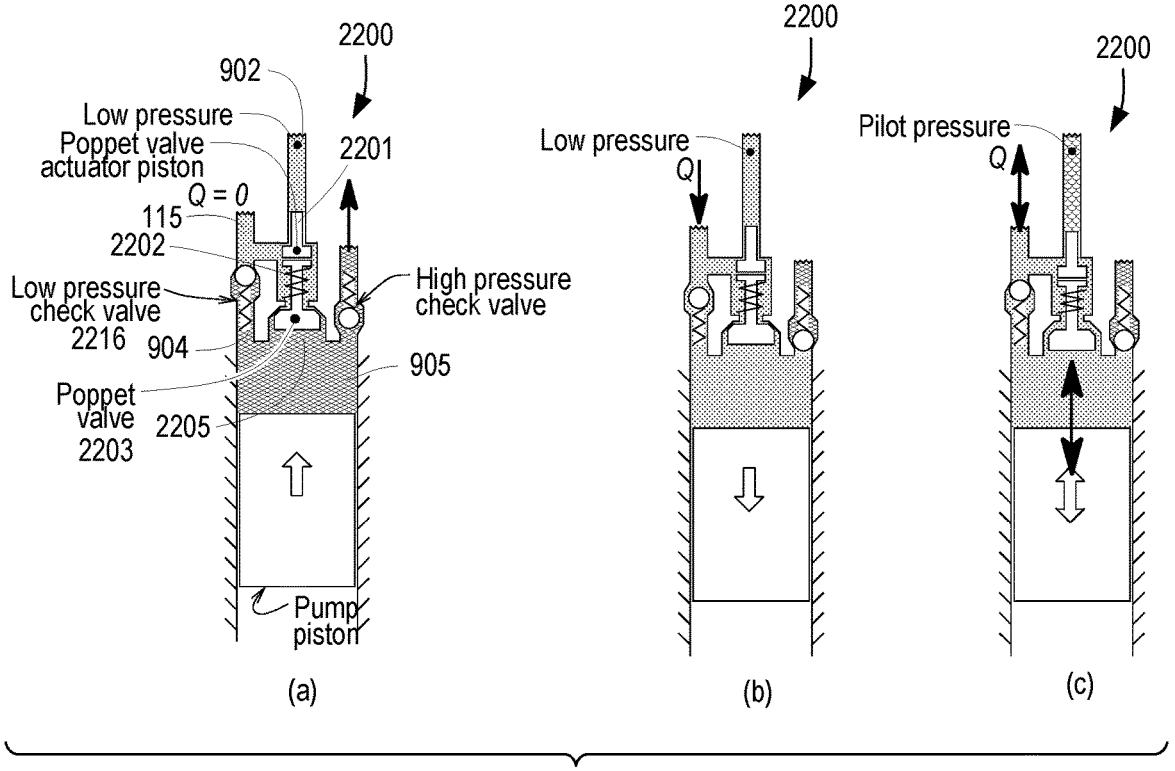

In another embodiment, a pilot-driven poppet valve operating in parallel with a conventional check valve 2216 can be used as a latching check valve 2200, as illustrated in FIG. 22. Note that while this implementation uses more than one valve to replace a single latching check valve (e.g., as shown in FIGS. 10A and 10B), the multiple valves will still be referred to herein in the singular as a latching check valve 2200. Similar to the embodiment shown in FIG. 21, the check valve 2216 includes a center cavity, a seat, and a blocking member. The poppet valve 2203 is a normally closed valve which is operated by a piston 2201 coupled to the latch supply line 902. A spring 2202, or other biasing device, pulls the poppet valve to the closed position when low pressure is supplied to the poppet valve actuator piston 2201. The check valve then operates in the normal manner, as illustrated in views (a) and (b) of FIG. 22 and FIG. 8. If pilot pressure is supplied to the piston 2201 which operates the poppet valve 2203, the poppet valve 2203 directly connects the working volume of fluid 905 to the low pressure supply (see view (c) of FIG. 22). In this case, fluid can flow between the low pressure supply 115 and second low pressure port 2205 in either direction.

Note that the latching check valve alternative illustrated in FIG. 10A has the benefits of fewer parts and smaller size compared to the embodiment 2200 which includes a poppet valve. A discrete poppet valve actuator piston 2201 is optional; the fluid in the latch supply line could act directly on a piston integrated onto the stem of the poppet valve 2203. In this embodiment, the pilot-driven poppet valve 2203 provides an alternative fluid path around the check valve 2216 rather than by holding the blocking member of the check valve in a position that is displaced from the check ball seat (see, e.g., FIGS. 10A and B). Nonetheless, this alternative fluid path maintains (latches) a bypass state (e.g., allows flow in either direction between low pressure supply 115 and second low pressure port 2205) when the latch supply line 902 changes from low pressure to pilot pressure or vice versa, therefore the valve 2200 functions as a latching check valve.

The novel "augmented check ball" pump described here achieves high efficiency by utilizing the self-adjusting timing feature characteristic of check ball pumps. However, it supersedes the check ball pump design by adding variable displacement functionality. The pump architecture is relatively simple for a variable displacement design. Therefore, it is affordable as well as efficient. In addition, it is robust, as it replaces complex mechanical systems or electronic controls that are usually used to implement variable displacement with a simple and rugged hydromechanical displacement controller.

The following section describes a high efficiency motor employing partial stroke piston pressurization. Check ball motors do not exist, as simple check valves alone can not be configured in a way to achieve a motoring function. However, the PSPP pump design can be extended to realize a variable displacement motor design that exploits some of the highly efficient self-adjusting timing features of a check ball pump.

Figure 23:
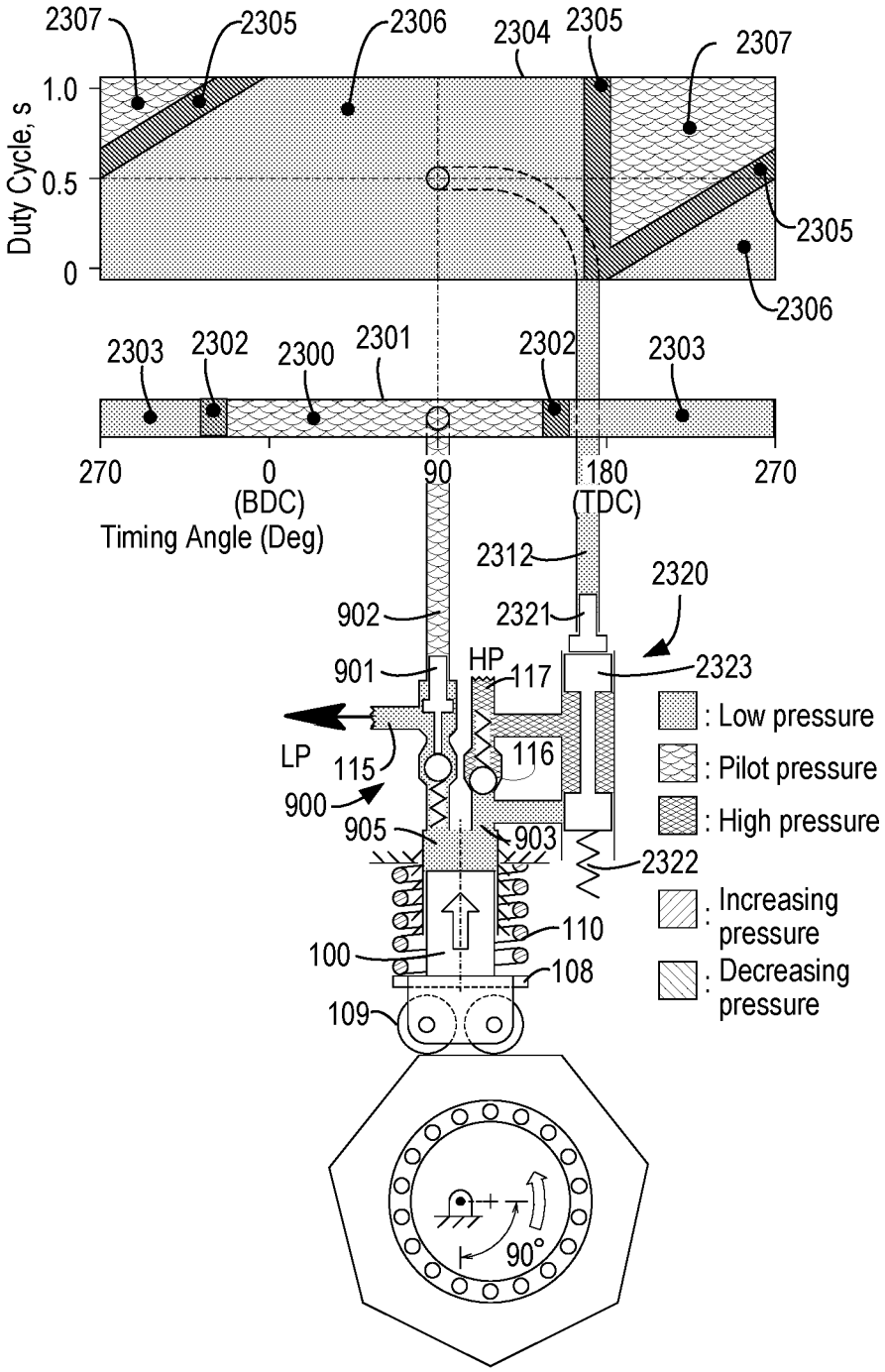
FIGS. 23-32 are schematic diagrams showing example positions of a motor according to an example embodiment.

The architecture of a highly efficient PSPP motor is suggested in FIG. 23, in which reference numbers from other embodiments are used to indicate like components in FIGS. 23-32. These figures assume the latching check valve architecture of FIG. 10A, but the motor could also be implemented to use the valve architecture of FIG. 10B, e.g., by reversing pilot and low pressures in diagram 2301. Three modifications are made to the check ball pump design. The first modification, seen in timing diagram 2301, includes changing the lands 2302 on the rotary valve to control the latching check valve 900 which connects the working volume 905 to the low pressure supply 115. This part of the rotary valve is simpler than the prior design (e.g., as indicated by valve timing diagram 910 in FIG. 9); it has only two axial lands 2302 separating low and pilot pressure regions 2300, 2303. This rotary valve is described herein as the "latching check valve controller."

The second modification includes adding an active valve in parallel with the high pressure check valve 116. In this embodiment, the active valve is a spool valve 2320 similar to what is shown in FIG. 21, and includes piston 2321, biasing element 2322, and spool 2323. Note that the high pressure check valve 116 is not mandatory as under normal operating conditions, it may never open. However, it is desirable, as it protects the piston cylinder from overpressurization. While the active valve is shown as a spool valve 2320 in FIG. 23, other active valve types, such as poppet valves (see FIG. 22), could be used. The active valve 2320 is driven by a hydraulically activated piston 2321 that is driven by an active valve supply line 2312.

The third modification includes adding a second rotary valve to control the active valve piston 2321 using a pilot pressure signal. Timing diagram 2304 shows the configuration of this second rotary valve. The second rotary valve has a helical land 2305 that is similar in design to the rotary valve utilized on the PSPP pump (e.g., timing diagram 910 in FIG. 9). This second rotary valve is described here as the "active valve controller." Note that the valve pockets 2306, 2307 containing low pressure and pilot pressure are different between the pump and motor valves.

In an alternative design, the pressure signal from the active valve controller may be applied directly to the end of the spool valve, e.g., the piston 2321 between the active valve supply line 2312 and the spool valve can be eliminated. In other words, the spool valve may be integrated with the piston. However, the separate piston may decrease the valve response time because it can be sized smaller than the spool valve diameter.

The first rotary valve represented by diagram 2301, serving as the latching check valve controller, can be constructed in two different ways. First, it can be built as an integral extension of the rotary valve containing the helical land represented by diagram 2304. In this case, it translates in the axial direction along with the portion containing the helical land. Therefore, it should have sufficient axial length to accommodate the axial port that feeds the latch piston of the latching check valve plus the length of travel of the portion containing the helical land 2305. Alternatively, the first rotary valve can be separated from the second rotary valve containing the helical land (but with its rotary motion synchronized with that valve). In the latter case, the first valve need not translate with the portion containing the helical land 2305. Therefore, its axial length can be reduced, yielding a more compact design overall. In the latter case, the land 2302 need not be oriented purely axially. For purposes of this disclosure, the description of separate rotary valves (e.g., first and second rotary valve having first and second spools) is understood to also apply to a single rotary valve that combines the different lands 2302, 2305 into a single spool and is enclosed by a single sleeve with at least two ports. Such a valve may be functionally equivalent to two physically separate valves.

A set of three valves including the latching check valve 900, high pressure check valve 116 and active valve 2320 are used for every cylinder. However, similar to the PSPP pump, only one set of rotary valves, including one active valve controller and one latching check valve controller, is needed to control all the valves in a PSPP motor.

Figure 31:
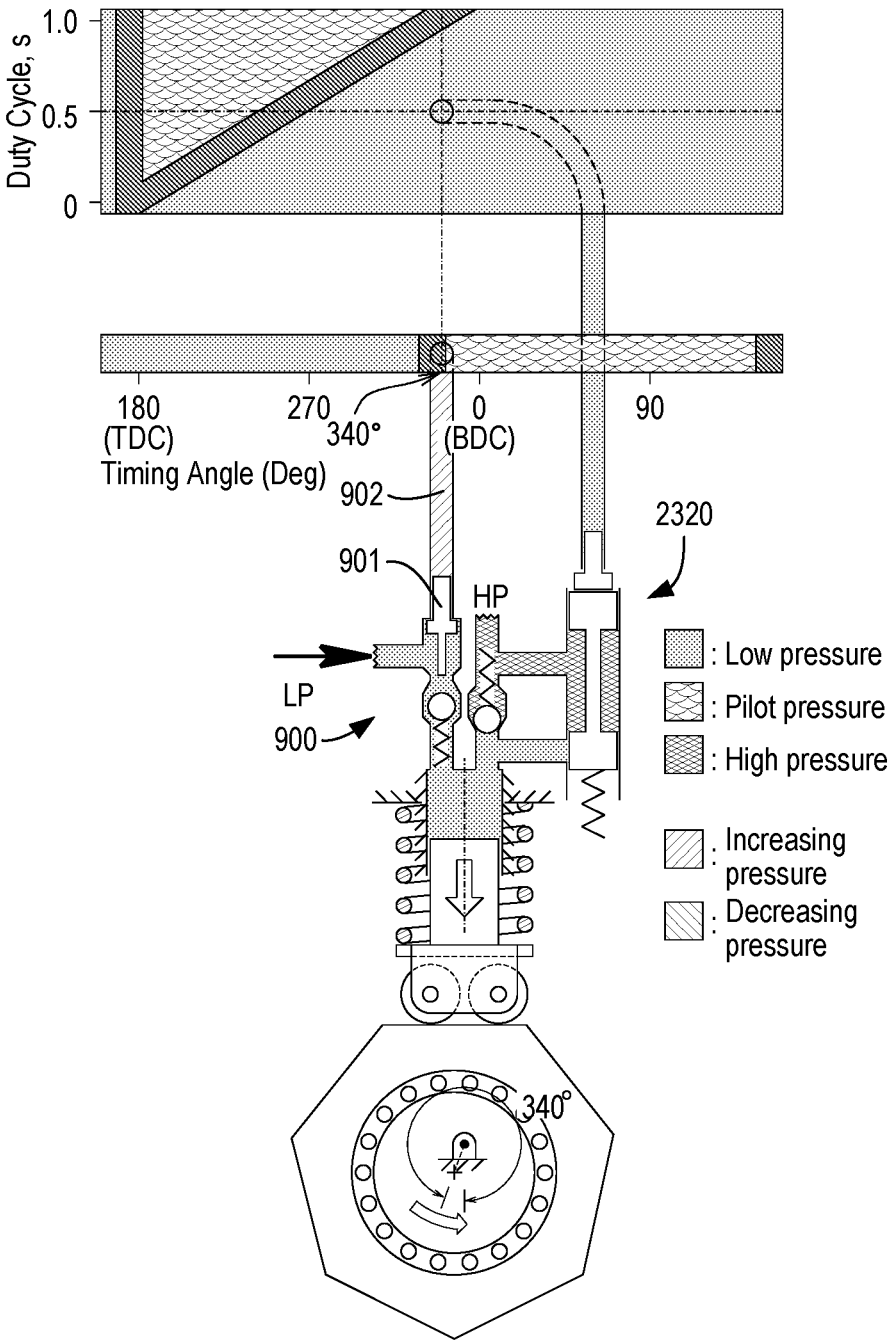
Figure 32:
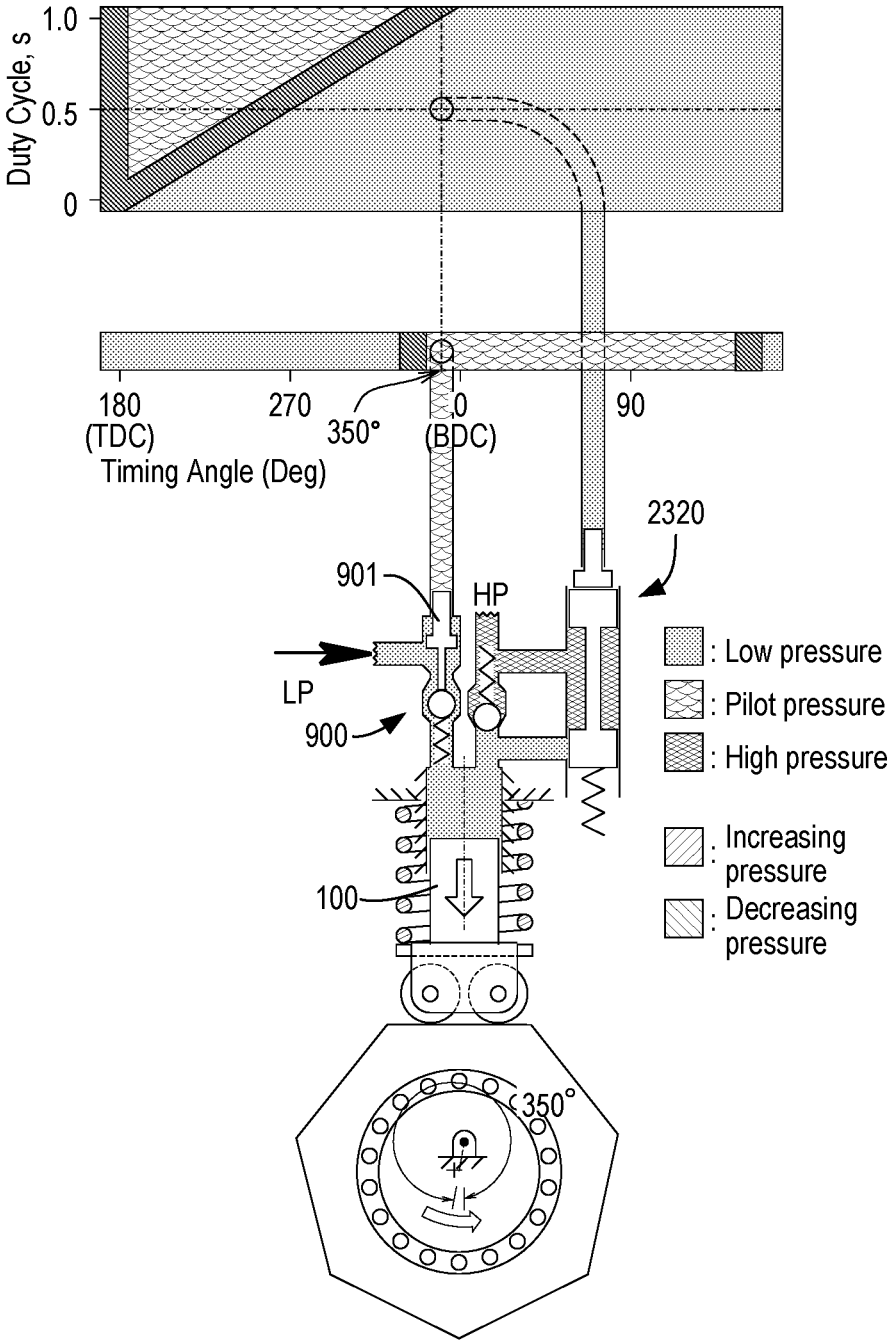

Assume that the motor is designed to operate with the shaft traveling in the CCW direction. The active valve controller sends low pressure to the active valve 2320 for nominally the entirety of the upstroke of the piston, and the active valve remains closed. The latching check valve 900 will remain open for the majority of travel of the piston from BDC to TDC (0 to 180°) so that low pressure fluid is evacuated from the piston cylinder. As explained later, the latching check valve 900 is opened prior to the piston reaching BDC (~350°; see FIG. 32). The latching check valve controller applies pilot pressure to the latch piston 901 to hold the low pressure check valve open from slightly before BDC to a few degrees before TDC. This application of the pilot pressure as seen in FIGS. 31 and 32 is also called a first change of pressure to the latch supply line 902 that maintains a bypass state in the latching check valve 900. In this example, the first change of pressure is a change from low to pilot pressure, but can be the opposite in some embodiments. The first change of pressure is reversed in FIG. 24.

Figure 24:
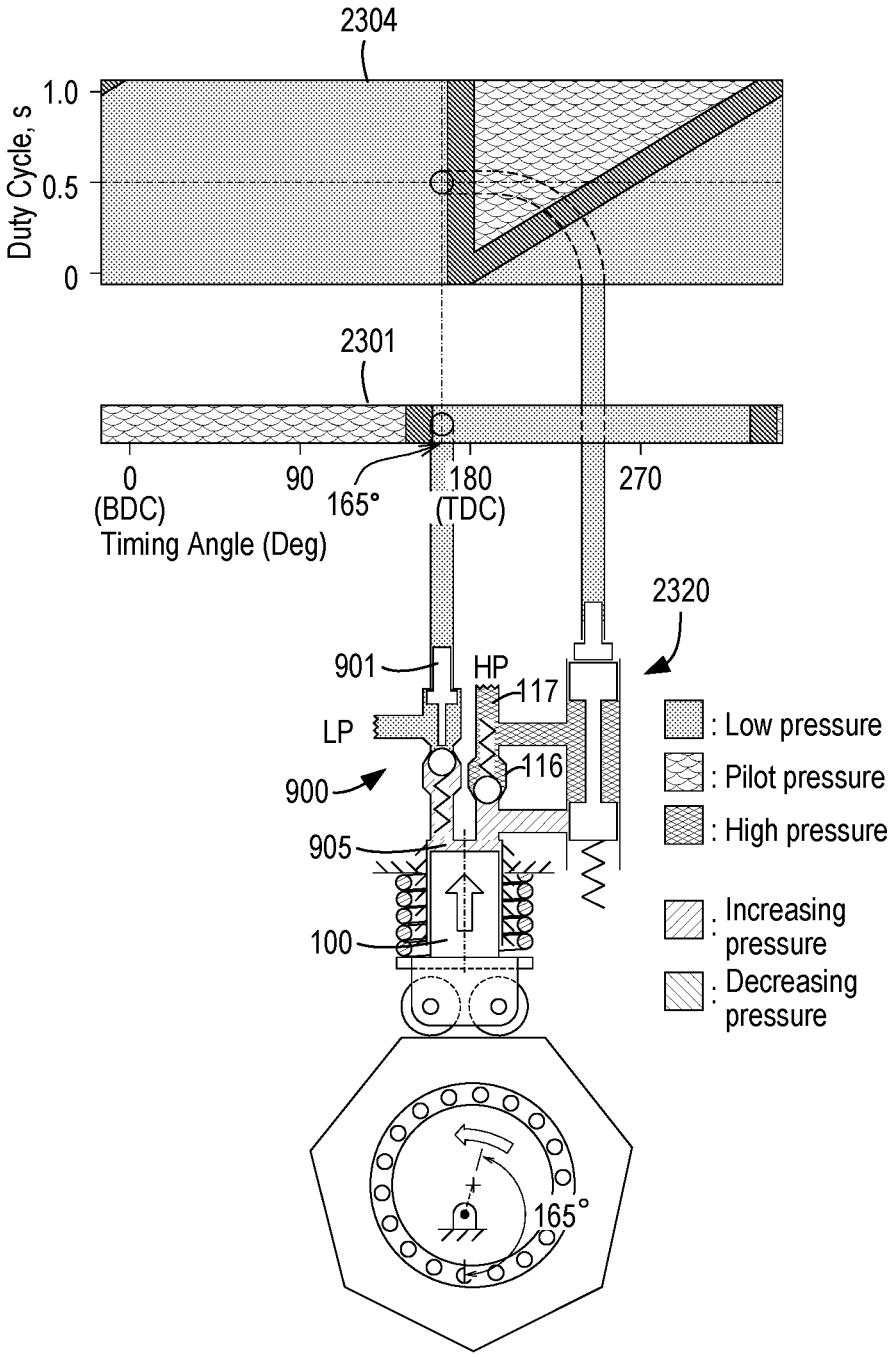

The piston 100 is shown approaching TDC in FIG. 24. The latching check valve controller (represented by timing diagram 2301) ports low pressure (reverses the first change of pressure) to the latching check valve 900 at about this point. The high pressure active valve 2320 is closed. Torque applied to the shaft by other pistons and/or rotary inertia of the shaft causes the shaft to continue to turn. The rising piston 100 causes the pressure in the working volume to be greater than that in the low pressure supply. The pressure differential across the latching check valve 900 causes the latching check valve 900 to close and the latch piston 901 to retract (unlatch). Once closed, the pressure of the working volume rises rapidly.

Figure 25:
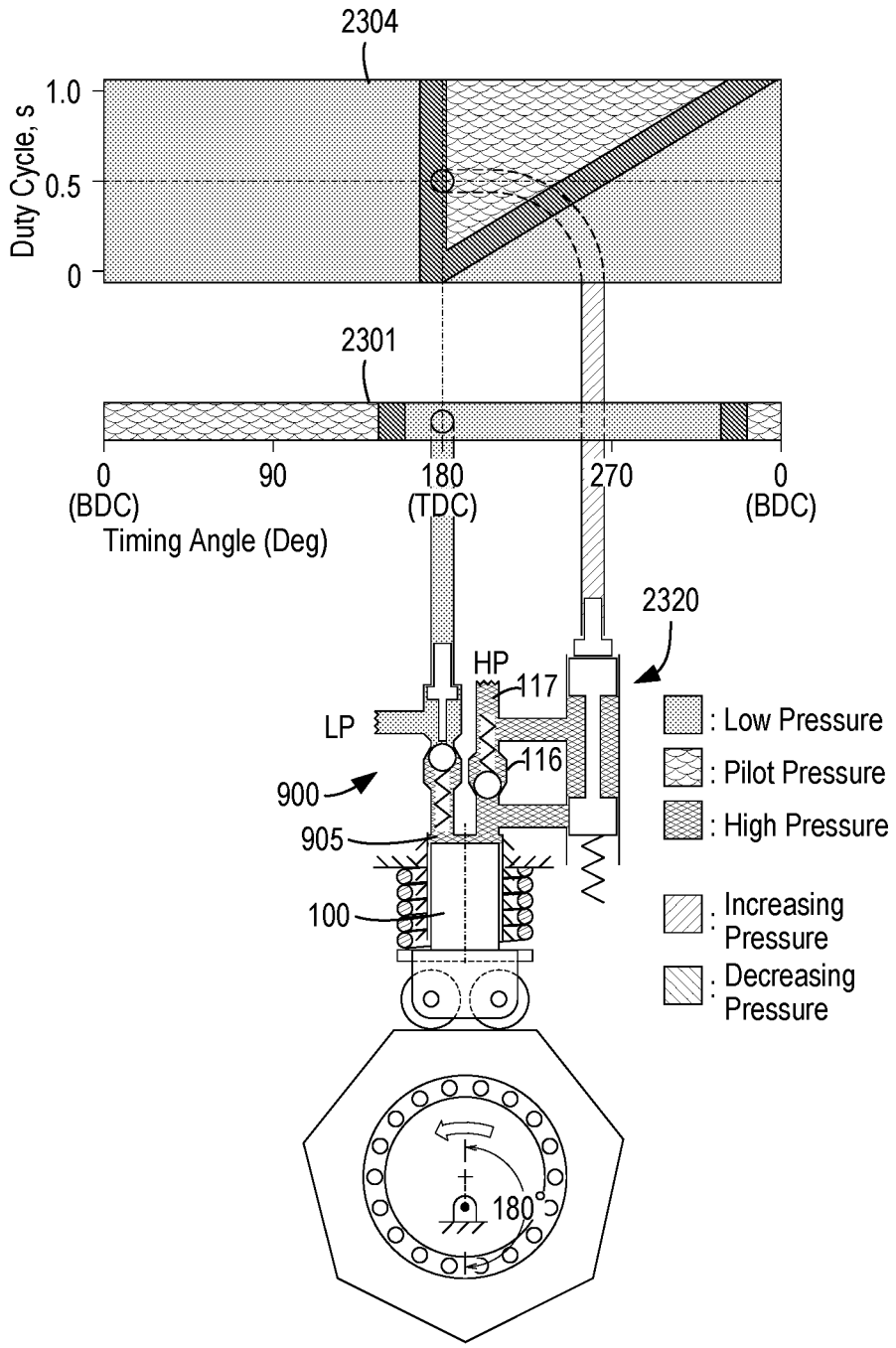

The diagram in FIG. 25 illustrates the state of the motor at TDC. Ideally, the pressure of the working volume exactly reaches that of the high pressure supply as TDC is crossed. The active valve controller is designed to send pilot pressure to the active valve 2320 slightly before TDC. A brief delay occurs before the active valve 2320 connects the working volume 905 to the high pressure supply 117. The delay is attributable to compressibility of the fluid in the active valve supply line 2312 and motion of the active valve 2320. The active valve 2320 opens slightly after TDC. As the latching check valve controller (represented by timing diagram 2301) is designed so that fluid in the working volume nominally also reaches high pressure at TDC, no pressure differential exists across the active valve 2320 as it opens and no throttling occurs.

Unlike the PSPP pump, the motor does not have self-adjusting timing at the point where high pressure is applied to the piston 100, as explained below. However, the timing does self-adjust when low pressure is applied to the piston 100.

The motor is designed to match the cylinder pressure to the high pressure for some specific combination of operating pressure, shaft speed and fluid properties. If the operating conditions vary from these conditions, a perfect match will not occur. In the case that the latching check valve 900 closes too early for the actual operating conditions, the pressure of the working volume 905 will start to rise above the high pressure, and the high pressure check valve 116 will open. In this case, the high pressure fluid is returned to the system. Throttling is minimized, as the pressure difference between the working volume 905 and the high pressure supply 117 is limited to $p_{check}$. However, some energy will be lost to friction. In the case that the latching check valve 900 closes too late, the pressure of the working volume 905 will not reach the pressure of the high pressure supply at TDC, and throttling will occur as the active valve opens. Nevertheless, the working volume 905 is at its minimum at TDC, so the effects of imperfect timing are reduced.

Figure 26:
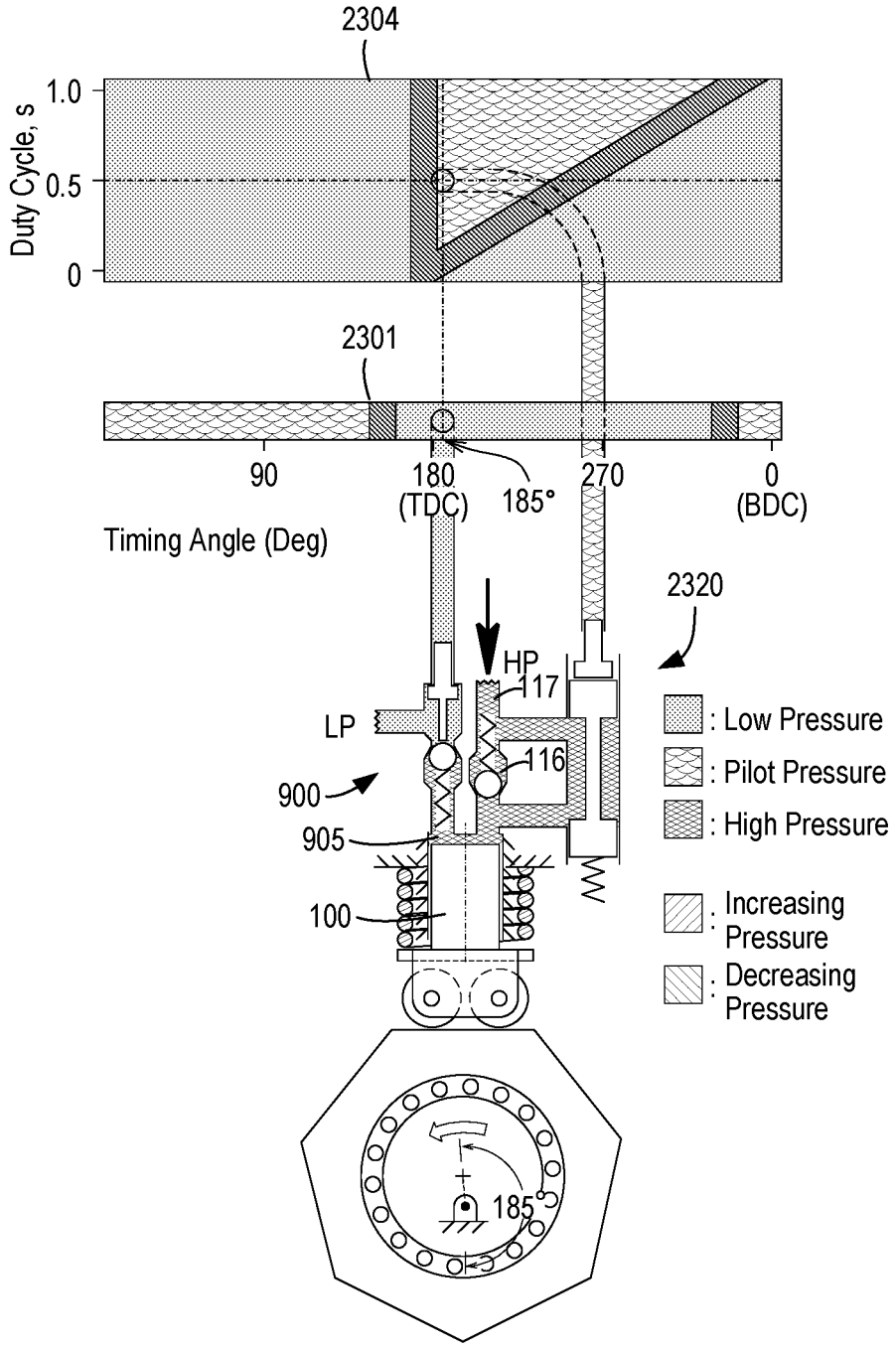

The diagram in FIG. 26 illustrates the state of the motor for the majority of the power stroke. Both check valves are closed. Pilot pressure from the active valve controller keeps the active valve 2320 open. Fluid flows from the high pressure supply 117 to the piston cylinder, driving the piston 100 downward.

Figure 27:
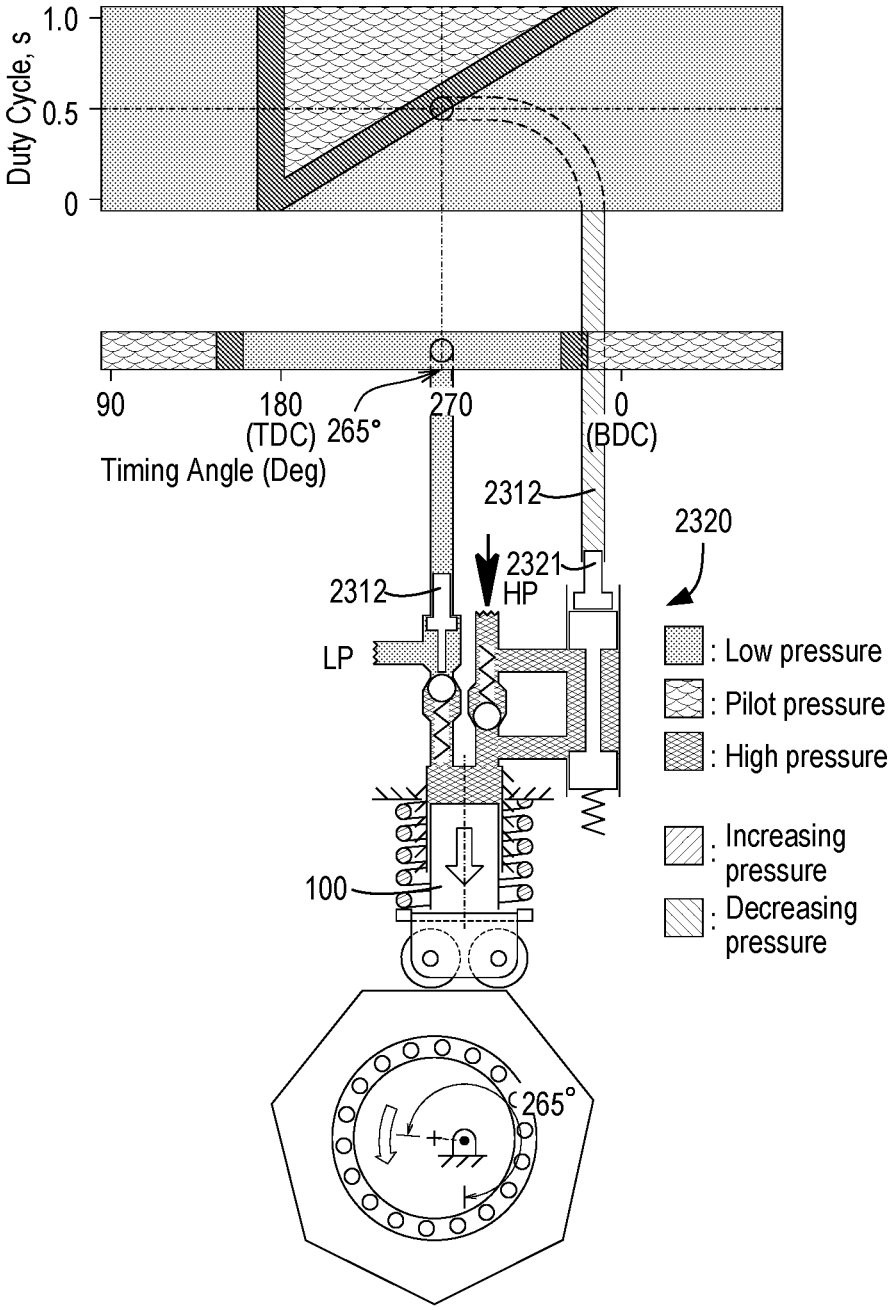
Figure 28:
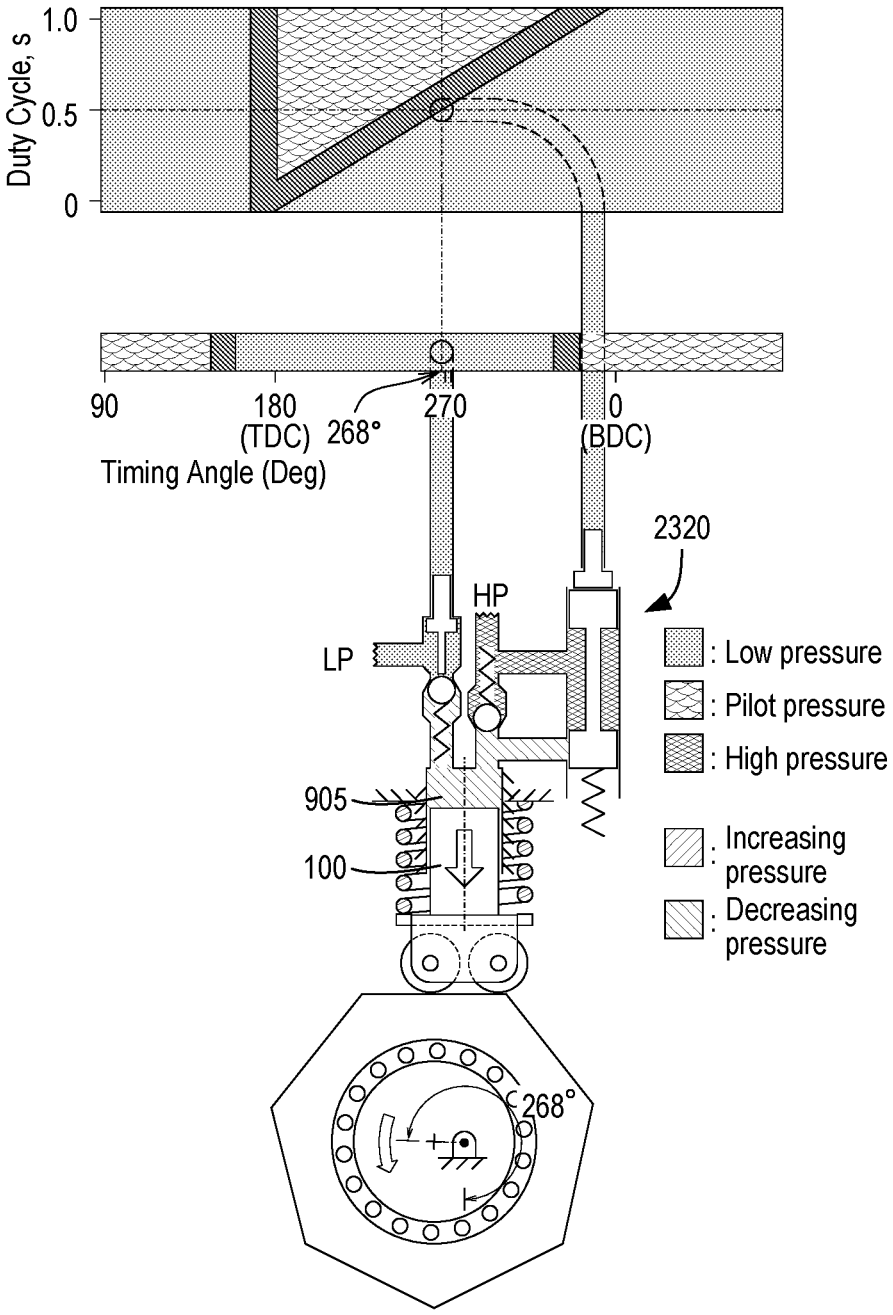

The diagram in FIG. 27 shows the sequence of events which begins as the piston 100 approaches 50% of its downward stroke (for a duty cycle setting of 50%). First, the active valve controller connects the active valve supply line 2312 to low pressure which is applied to the piston 2321. This is a second change of pressure applied to the active valve supply line 2312 which causes active valve 2320 to block high pressure fluid from entering the cylinder. In this case, the second change of pressure is a change from pilot pressure to low pressure, but can be the opposite in some embodiments. The second change of pressure is reversed as seen in FIG. 25. After a brief delay, the high pressure valve 2320 closes (FIG. 28). All valves are now closed. The piston 100 continues its downward travel, so the pressure of the fluid in the working volume 905 drops.

Figure 29:
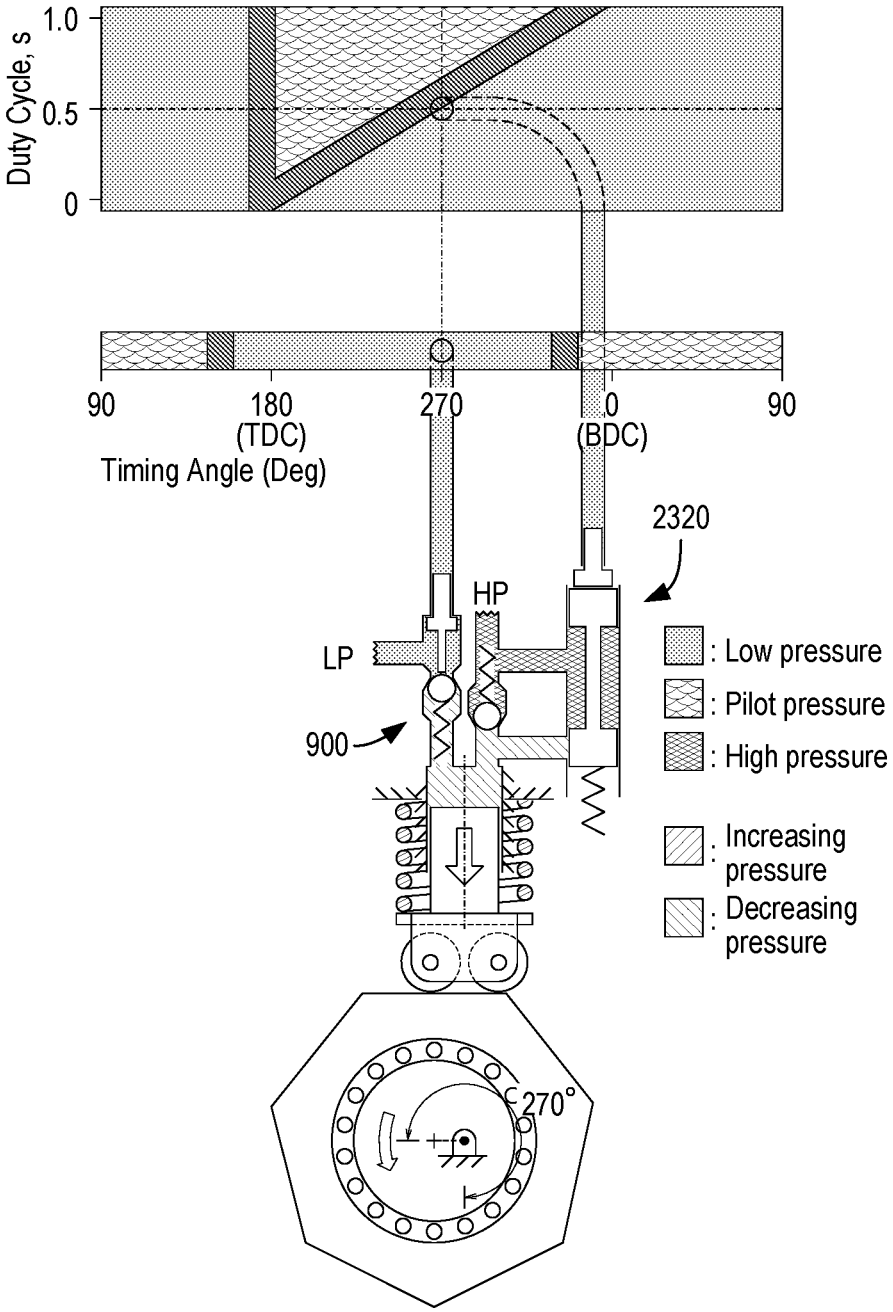

However, the fluid continues to do work on the piston as long as the cylinder pressure remains above low pressure. The cylinder pressure continues to drop until it drops slightly below low pressure (FIG. 29). The latching check valve 900 then opens. Note that the differential pressure across the latching check valve 900 is only $p_{check}$, so throttling losses are low. In addition, the crank angle at which the latching check valve 900 opens will self-adjust to compensate for differences in operating pressure, speed, and fluid properties.

Figure 30:
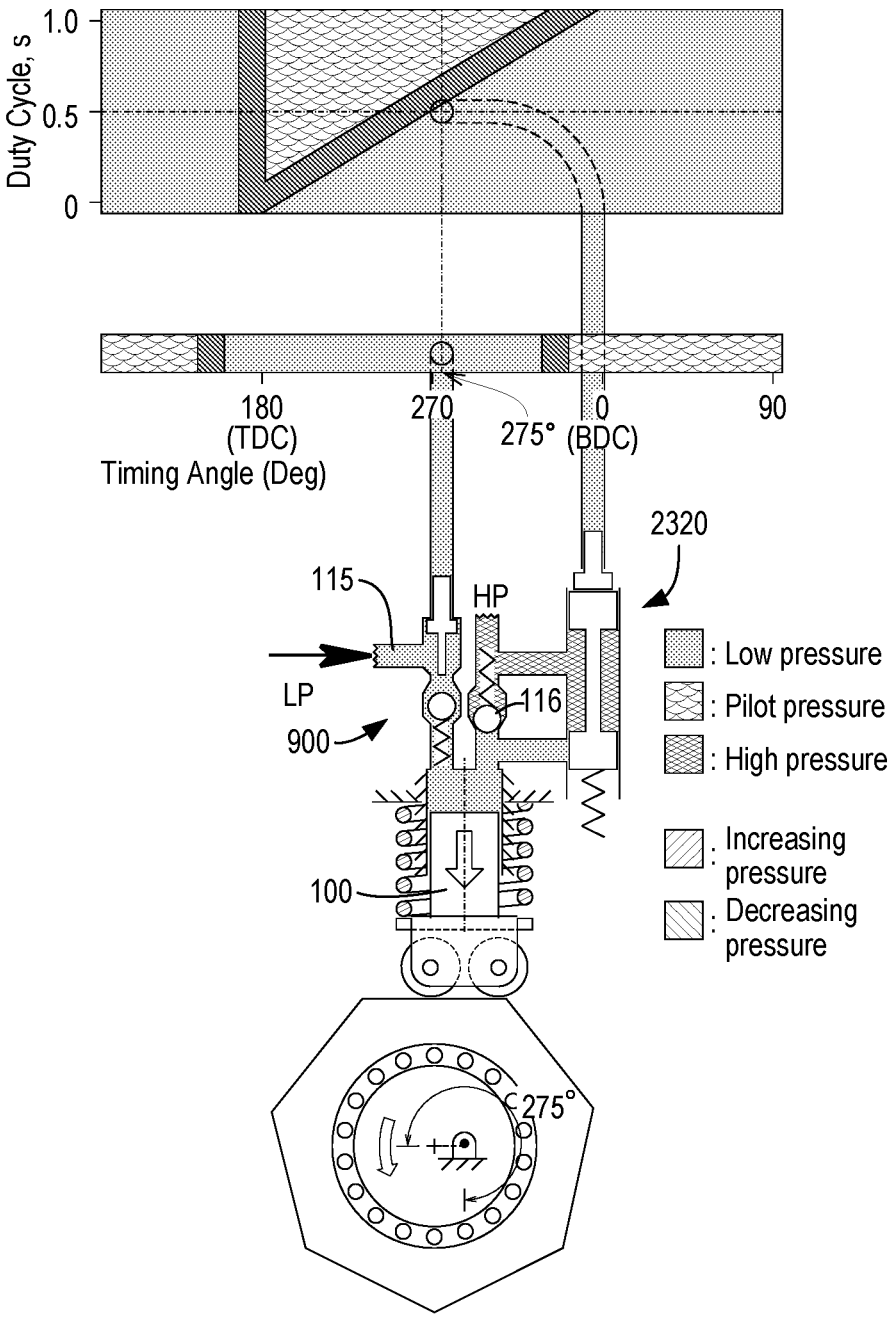

The piston 100 then completes most of its travel to BDC with both high pressure valves 116, 2320 closed (FIG. 30). The low pressure check valve 900 remains open due to the pressure drop caused by the continuing downward motion of the piston 100. Fluid from the low pressure supply 115 is drawn into the cylinder through the latching check valve 900.

Shortly before the piston reaches BDC, the latching check valve controller starts opening the latch supply line 902 to pilot pressure (FIG. 31). Fluid at pilot pressure starts flowing to the latch piston 901.

After a brief delay, the low pressure check valve 900 is latched open (FIG. 32). The latching check valve 900 is latched open before BDC is reached, as otherwise the pressure in the cylinder will start to increase once BDC is passed. If the pressure differential is sufficient to close the latching check valve 900 before the latch piston 901 latches it open, the latch piston 901 may not be able to overcome the pressure force on the blocking member to re-open it. If pressure on the piston 100 goes high on the return stroke, either the motor will stall or its torque output will drop significantly. The motor could continue to turn due to torque contributed by other pistons operating with proper timing.

A consequence of latching the low pressure check valve 900 open slightly before BDC is that the effective volumetric displacement of the motor will be slightly lower than the actual volumetric displacement of the piston in the cylinder. However, for typical cycloidal motion of the piston, the velocity of the piston is very low near BDC, and the volumetric loss is small. The volumetric loss can be compensated for by rating the maximum volumetric displacement of the motor slightly lower than that of the actual piston displacement.

Once past BDC, the valve settings return to those illustrated in FIG. 23, and the cycle repeats. Unlike the PSPP pump, perfect valve timing is not achieved for all operating conditions due to opening the high pressure valve at TDC with fixed timing. However, high overall efficiency is still achieved as a consequence of applying self-adjusting timing at the end of the piston's power stroke, regardless of motor displacement, due to incorporation of latching check valve 900 in the system.

FIGS. 23 through 32 assume that the shaft is rotating in the counterclockwise direction. The lands on the rotary valve can be mirrored to enable operating the motor with a clockwise rotation of the shaft. A bi-directional motor can be constructed by including lands on the rotary valve to enable both counterclockwise and clockwise rotation.

Note that in the embodiment shown above, the coupling of the pilot pressure supply to the active valve supply line 2312 causes the active valve 2320 to port the fluid at the high pressure to the cylinder during a first part of a downstroke of the piston 100 (FIGS. 26-27). Coupling of the low pressure supply to the active valve supply line 2312 causes the active valve to block the fluid at high pressure from entering the cylinder during a second part of the downstroke (FIGS. 23-24 & 28-32). However, the active valve 2320 may be configured oppositely. Namely, the active valve may be configured such that coupling of the low pressure supply to the active valve supply line 2312 causes the active valve 2320 to port the fluid at the high pressure to the cylinder during a first part of a downstroke of the piston. In this configuration, coupling of the pilot pressure supply to the active valve supply line 2312 causes the active valve to block the fluid at the high pressure from entering the cylinder during a second part of the downstroke. For example, as shown in FIG. 23, this alternate configuration could interchange the location of the actuator piston 2321 and biasing member 2322 relative to the sliding spool 2323. Also, the low and pilot pressures would be reversed in pockets 2306 and 2307 from what is shown in FIG. 23.

A combined pump-motor can be constructed by merging the valve systems described in relation to FIGS. 12-20 and 23-32. The valve set comprising the latching check valve 900, high pressure check valve 116, and active valve 2320, as illustrated in FIGS. 23-32, is implemented for every piston.

The active valve is controlled by a rotary valve profile identical to the active valve controller profile 2304 in FIGS. 23-32 for the motoring regime, but it is disabled for the entirety of the pumping regime. The active valve 2320 can be disabled by applying low pressure to the active valve supply line 2312. This assumes that the active valve is set up so that exposing active valve supply line 2312 to low pressure shuts off the supply of high pressure fluid to the cylinder. In the case of the alternative arrangement described above, pilot pressure would be applied to the active valve supply line 2312 instead of low pressure.

The low pressure can be obtained by either including an additional axial region on the rotary valve that is entirely exposed to low pressure or by including an additional three-way valve to switch the active valve supply line to the low pressure supply while pumping.

The latching check valve is controlled by a rotary valve profile 910 as in FIGS. 12-20 for the pumping regime, and a latching check valve controller profile 2301 as in FIGS. 23-32 for the motoring regime. All rotary valve profiles, two for pumping and one or two for motoring, can be included on a single rotary valve if desired.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g., 1 to 5 includes 1, 1.5, 2, 2.75, 3, 3.80, 4, and 5) and any range within that range.

For purposes of this disclosure, descriptions of relative position or orientation, such as top, bottom, side, up, down, above, below, besides, beneath, left, right, etc., are not meant to require any orientation relative to a fixed reference such as the earth's surface. Unless otherwise indicated, such relative terms of position or orientation may be used to conveniently describe the relative location of objects within the figures and are not intended to limit the use or structure of articles of manufacture that implement the claimed subject matter to a particular orientation.

The foregoing description of the example embodiments has been presented for the purposes of illustration and description. It is not intended to be exhaustive or to limit the embodiments to the precise form disclosed. Many modifications and variations are possible in light of the above teaching. Any or all features of the disclosed embodiments applied individually or in any combination are not meant to be limiting, but purely illustrative. It is intended that the scope of the invention be limited not with this detailed description, but rather determined by the claims appended hereto.

The invention claimed is:

1. An apparatus configurable as one or both of a partial stroke pump or a partial stroke motor, comprising:

a piston coupled to a rotating shaft to evacuate a fluid within a cylinder during an upstroke;

a latching check valve in fluid communication with: a low pressure port of the cylinder;

a low pressure supply line at a low pressure; and a latch supply line; and a rotary valve selectively coupling one of the low pressure supply and a pilot pressure supply of the fluid to the latch supply line over different timing angle ranges of the rotating shaft, the pilot pressure supply having a pressure greater than the low pressure, wherein a pressure change between the low pressure and the pilot pressure applied by the rotary valve to the latch supply line during each pumping upstroke or motoring upstroke of the piston causes the latching check valve to change between a bypass state and a conventional check valve state, wherein, when operating as the partial stroke pump, the bypass state allows the pressure in the cylinder to fall below a high pressure during a first part of each pumping upstroke and the conventional check valve state allows the pressure in the cylinder to rise to the high pressure during a second part of each pumping upstroke, and wherein when operating as the partial stroke motor, the bypass state allows the fluid to be evacuated from the cylinder at a low pressure during a first part of each motoring upstroke and the conventional check valve state allows the pressure in the cylinder to increase during a second part of each motoring upstroke.

2. The apparatus of claim 1, wherein the rotary valve comprises a spool rotatably coupled to the rotating shaft, and when configured as the partial stroke pump, the spool of the rotary valve is selectively translatable relative to a sleeve of the rotary valve to change the different timing angle ranges, the change in the different timing angle ranges resulting in changing of a duty cycle of the partial stroke pump.

3. The apparatus of claim 2, wherein the rotary valve further comprises:

a helical or approximately helical land wrapped around the spool and a sleeve surrounding the spool and rotatably fixed relative to the rotating shaft; and an orifice in the sleeve that is fluidly coupled to the latch supply line, the land separating the low pressure supply and the pilot pressure supply by forming respectively a low pressure region and a pilot pressure region between the spool and the sleeve, the low pressure region and the pilot pressure region being selectively coupled to the orifice over the different timing angle ranges.

4. The apparatus of claim 1, wherein the latching check valve comprises:

a check valve coupled between the low pressure supply line and the low pressure port; and a spool valve or a poppet valve that opens an alternate fluid supply path that bypasses the check valve in the bypass state.

5. The partial stroke motor of claim 1 further comprising:

an active valve in parallel with a high pressure check valve, the high pressure check valve opening or closing a high pressure port of the cylinder if a pressure of the fluid in the cylinder goes respectively above or below a high pressure, the active valve driven by a second actuator piston fluidly coupled to an active valve supply line; and a second rotary valve in fluid communication with the active valve supply line and comprising a second spool rotatably coupled to the rotating shaft, the second spool selectively coupling one of the low pressure supply and the pilot pressure supply of the fluid to the active valve supply line over different second timing angle ranges of the rotating shaft.

6. The apparatus of claim 5, wherein the coupling of the pilot pressure supply to the active valve supply line causes the active valve to port the fluid at the high pressure to the cylinder during a first part of a downstroke of the piston, the coupling of the low pressure supply to the active valve supply line causing the active valve to block the fluid at the high pressure from entering the cylinder during a second part of the downstroke.

7. The apparatus of claim 5, wherein the coupling of the low pressure supply to the active valve supply line causes the active valve to port the fluid at the high pressure to the cylinder during a first part of a downstroke of the piston, the coupling of the pilot pressure supply to the active valve supply line causing the active valve to block the fluid at the high pressure from entering the cylinder during a second part of the downstroke.

8. The apparatus of claim 5, wherein the active valve comprises a spool valve with a sliding spool that is integrated with the second actuator piston.

9. The apparatus of claim 1, wherein the change of pressure to the latch supply line that maintains the bypass state is a change from the low pressure to the pilot pressure.

10. An apparatus configurable as one or both of a partial stroke pump or a partial stroke motor, comprising:

a piston coupled to a rotating shaft to evacuate a fluid within a cylinder during an upstroke;

a latching check valve in fluid communication with: a low pressure port of the cylinder; a low pressure supply line at a low pressure; and a latch supply line, wherein the latching check valve comprises:

a center cavity in fluid communication with the low pressure port;

a seat between the low pressure supply line and the center cavity;

a blocking member biased to move towards the seat and to block flow therethrough when the pressure in the cylinder is above the low pressure; and a latch piston contacting the blocking member to hold the blocking member away from the seat in a bypass state to bypass the blocking member; and a rotary valve selectively coupling one of the low pressure supply and a pilot pressure supply of the fluid to the latch supply line over different timing angle ranges of the rotating shaft, the pilot pressure supply having a pressure greater than the low pressure, wherein a change from low pressure to pilot pressure or vice versa to the latch supply line maintains the bypass state of the latching check valve, wherein, when operating as the partial stroke pump, the bypass state allows the pressure in the cylinder to fall below a high pressure during part of the upstroke, wherein when operating as the partial stroke motor, the bypass state allows the fluid to be evacuated from the cylinder during the upstroke, and wherein the latch piston is separable from the blocking member when not in the bypass state such that the blocking member and seat act as a conventional check valve when not in the bypass state.

11. The apparatus of claim 10, wherein when configured as the partial stroke pump, the piston is driven by the rotating shaft to compress the fluid within the cylinder during the upstroke, the cylinder comprising high pressure and low pressure ports, the apparatus further comprising a high pressure check valve that opens or closes the high pressure port if a pressure of the fluid in the cylinder goes respectively above or below a high pressure, the high pressure check valve being closed in the bypass state.

12. The apparatus of claim 11, wherein a spool of the rotary valve is selectively translatable relative to a sleeve of the rotary valve to change the different timing angle ranges, the change in the different timing angle ranges resulting in changing of a duty cycle of the partial stroke pump.

13. The apparatus of claim 12, wherein the rotary valve further comprises:

a helical or approximately helical land wrapped around the spool, the sleeve surrounding the spool and rotatably fixed relative to the rotating shaft; and an orifice in the sleeve that is fluidly coupled to the latch supply line, the land separating the low pressure supply and the pilot pressure supply by forming respectively a low pressure region and a pilot pressure region between the spool and the sleeve, the low pressure region and the pilot pressure region being selectively coupled to the orifice over the different timing angle ranges.

14. The apparatus of claim 11, wherein the latch piston contacts the blocking member to hold the blocking member away from the seat in the bypass state to bypass the blocking member.

15. The apparatus of claim 11, wherein the latching check valve comprises a check valve that includes the center cavity, the seat, and the blocking member, the latching check valve further comprising a spool valve or a poppet valve that opens an alternate fluid supply path that bypasses the check valve.

16. The apparatus of claim 11, wherein the change of pressure to the latch supply line that maintains the bypass state is a change from the low pressure to the pilot pressure.

17. A partial stroke motor, comprising:

a piston moving within a cylinder, the piston driving a rotating shaft responsive to a fluid at a high pressure flowing into the cylinder during a downstroke, the cylinder comprising a high pressure port and a low pressure port;

a latching check valve in fluid communication with the low pressure port, the latching check valve comprising:

a center cavity in fluid communication with the low pressure port;

a seat between a low pressure supply of the fluid at a low pressure and the center cavity;

a blocking member biased to move towards the seat and to block flow therethrough when the pressure in the cylinder is above the low pressure;

an actuator piston that is linearly displaceable within the center cavity to bypass the blocking member from blocking the flow in a bypass state of the latching check valve, the actuator piston driven by a latch supply line;

a first rotary valve in fluid communication with the latch supply line and comprising a first spool rotatably coupled to the rotating shaft, the first spool selectively coupling one of the low pressure supply and a pilot pressure supply of the fluid to the latch supply line over different timing angle ranges of the rotating shaft, the pilot pressure supply having a pressure greater than the low pressure, a first change of pressure to the latch supply line maintaining the bypass state, the bypass state allowing the fluid to be evacuated from the cylinder during an upstroke of the piston;

an active valve in fluid communication with the high pressure port, the active valve driven by a second actuator piston fluidly coupled to an active valve supply line; and a second rotary valve in fluid communication with the active valve supply line and comprising a second spool rotatably coupled to the rotating shaft, the active valve spool selectively coupling one of the low pressure supply and the pilot pressure supply of the fluid to the active valve supply line over different second timing angle ranges of the rotating shaft, a second change in pressure to the active valve supply line causing the active valve to block the fluid at the high pressure from entering the cylinder during part of the downstroke.

18. The partial stroke motor of claim 17, further comprising a high pressure check valve in parallel with the active valve, the high pressure check valve opening or closing if the pressure of the fluid in the cylinder goes respectively above or below the high pressure.

19. The partial stroke motor of claim 17, wherein the second rotary valve further comprises:

a helical or approximately helical land wrapped around an outer surface of the second spool;

a second sleeve surrounding the second spool that is rotatably fixed relative to the rotating shaft; and a second orifice in the second sleeve that is fluidly coupled to the active valve supply line, the land separating the low pressure supply and the pilot pressure supply by forming respective second low pressure region and second pilot pressure region between the second spool and the second sleeve, the second low pressure region and the second pilot pressure region being selectively coupled to the orifice over the different timing angle ranges.

20. The partial stroke motor of claim 17, wherein the first rotary valve further comprises:

an axial or approximately axial land extending along an outer surface of the first spool;

a first sleeve surrounding the first spool that is rotatably fixed relative to the rotating shaft; and a first orifice in the first sleeve being coupled to the latch supply line, the axial land separating the low pressure supply and the pilot pressure supply by forming respective first low pressure region and first pilot pressure region between the first spool and the first sleeve, the first low pressure region and the first pilot pressure region being selectively coupled to the orifice over the different timing angle ranges.

21. An apparatus configurable as one or both of a partial stroke pump or a partial stroke motor, comprising:

a piston coupled to a rotating shaft to evacuate a fluid within a cylinder during an upstroke;

a latching check valve in fluid communication with: a low pressure port of the cylinder; a low pressure supply line at a low pressure; and a latch supply line; and a rotary valve selectively coupling one of the low pressure supply and a pilot pressure supply of the fluid to the latch supply line over different timing angle ranges of the rotating shaft, the pilot pressure supply having a pressure greater than the low pressure, wherein a pressure change between the low pressure and the pilot pressure applied by the rotary valve to the latch supply line during each upstroke of the piston causes the latching check valve to change between a bypass state and a conventional check valve state, wherein the bypass state allows fluid to be evacuated from the cylinder at a low pressure during a first part of each upstroke and the conventional check valve state allows the fluid in the cylinder to increase to a high pressure during a second part of each upstroke.

* * * * *